US010403178B2

(12) United States Patent
Kaoh

(10) Patent No.: US 10,403,178 B2
(45) Date of Patent: Sep. 3, 2019

(54) LOTTERY SIGNS FOR DISPLAYING LOTTERY JACKPOTS OF MILLIONS AND BILLIONS OF DOLLARS

(71) Applicant: Andy K. F. Kaoh, Costa Mesa, CA (US)

(72) Inventor: Andy K. F. Kaoh, Costa Mesa, CA (US)

( * ) Notice: Subject to any disclaimer, the term of this patent is extended or adjusted under 35 U.S.C. 154(b) by 0 days.

(21) Appl. No.: 15/928,803

(22) Filed: Mar. 22, 2018

(65) Prior Publication Data

US 2018/0308398 A1 Oct. 25, 2018

Related U.S. Application Data

(63) Continuation-in-part of application No. 14/861,069, filed on Sep. 22, 2015, now Pat. No. 9,940,855.

(51) Int. Cl.

| | |
|---|---|
| ***G09F 9/30*** | (2006.01) |
| ***G09F 9/302*** | (2006.01) |
| ***G09G 3/14*** | (2006.01) |
| ***G09F 13/22*** | (2006.01) |
| ***G09F 13/04*** | (2006.01) |
| ***G09F 3/20*** | (2006.01) |

(52) U.S. Cl.

CPC ..... *G09F 9/3023* (2013.01); *G09F 3/202* (2013.01); *G09F 3/208* (2013.01); *G09F 13/04* (2013.01); *G09F 13/22* (2013.01); *G09G 3/14* (2013.01); *G09F 2013/222* (2013.01)

(58) Field of Classification Search

CPC ..... G09F 9/3023; G09F 3/208; G09F 9/33; G09G 3/14

See application file for complete search history.

(56) References Cited

U.S. PATENT DOCUMENTS

| | | | | |
|---|---|---|---|---|
| 3,782,016 | A * | 1/1974 | Ashton | G09F 9/30 40/451 |
| 5,753,900 | A * | 5/1998 | Goodwin, III | G09F 9/33 235/383 |
| 5,903,244 | A * | 5/1999 | Dewhurst | G09F 9/3023 345/34 |
| 6,317,184 | B1 * | 11/2001 | Kwan | G09F 9/302 349/139 |
| 7,880,755 | B1 * | 2/2011 | Potash | B41J 2/3359 347/200 |
| 2003/0072168 | A1 * | 4/2003 | Hou | G09F 9/30 362/545 |

(Continued)

*Primary Examiner* — Gary C Hoge

(74) *Attorney, Agent, or Firm* — Myers Andras LLP; Joseph C. Andras

(57) ABSTRACT

An illuminated display for displaying a lottery jackpot values in the range of millions and billions of dollars is disclosed. The lottery display has an LED array for selectively displaying either "MILLION" or "BILLION." A special LED module for representing an uppercase letter "M" or uppercase letter "B" is positioned next to a series of LED elements configured to display "ILLION." A special LED module having nine segments may be employed for the indicia of units, where the LED module may be illuminated to form the numerals 0 through 9, as well as an upper case letter "B." The illuminated display may also display indicia for currency and the day of the week for the jackpot draw.

13 Claims, 29 Drawing Sheets

(56) References Cited

U.S. PATENT DOCUMENTS

| | | | | |
|---|---|---|---|---|
| 2003/0156038 | A1* | 8/2003 | Hankins | G09F 9/33 340/815.45 |
| 2004/0233220 | A1* | 11/2004 | Decaux | G09F 9/00 345/619 |
| 2004/0246203 | A1* | 12/2004 | Nakaoka | G09F 9/305 345/39 |
| 2005/0102870 | A1* | 5/2005 | Catteau | G09F 9/302 40/450 |
| 2005/0134529 | A1* | 6/2005 | Lei | G09G 3/14 345/34 |
| 2006/0001598 | A1* | 1/2006 | Lei | G09F 9/302 345/34 |
| 2008/0028649 | A1* | 2/2008 | Van Ness | G09F 9/30 40/447 |
| 2012/0098735 | A1* | 4/2012 | Wu | G09F 9/302 345/46 |
| 2013/0255116 | A1* | 10/2013 | Kaoh | G09F 27/005 40/563 |
| 2014/0335976 | A1* | 11/2014 | Hiller | A63B 69/0071 473/447 |
| 2016/0042673 | A1* | 2/2016 | Wilson | G09F 9/33 40/541 |

* cited by examiner

305

LOTTERY SIGNS FOR DISPLAYING LOTTERY JACKPOTS OF MILLIONS AND BILLIONS OF DOLLARS

RELATED APPLICATION INFORMATION

The present application is a continuation-in-part of U.S. patent application Ser. No. 14/861,069 entitled "LOTTERY SIGNS FOR DISPLAYING LOTTERY JACKPOTS OF MILLIONS TO BILLIONS OF DOLLARS" filed on Sep. 22, 2015 and published as U.S. Pub. No. 2017/0084209, the disclosure of which is incorporated herein by reference in its entirety.

BACKGROUND OF THE INVENTION

1. Field of the Invention

The present invention relates in general to lottery display signs. More particularly, the invention is directed to lottery display signs which can display millions and billions of dollars for the lottery jackpot.

2. Description of the Related Art

Many governments rely on lotteries to raise government revenues. Electronic lottery signs are often used to highlight establishments which offer lottery tickets for sale as well as to inform the public of the current jackpot value, which may motivate some consumers to purchase lottery tickets when the jackpot is large. Lottery jackpots may exceed hundreds of millions of dollars, but may soon reach one billion dollars or more. Most conventional lottery signs, however, are not configured to display lottery jackpots which exceed one billion dollars.

Accordingly, a need exists to provide lottery signs which can display lottery jackpots in both millions and in excess of one billion dollars.

SUMMARY OF THE INVENTION

In the first aspect, an illuminated display for displaying a lottery jackpot value in the range of millions and billions of currency is disclosed. The display comprises a flat housing unit having a front surface, and an LED module mounted in the housing for representing an uppercase letter "M" or an uppercase letter "B" comprising a plurality of LED elements disposed to form a generally parallelogram perimeter having at least one top side LED element, at least one bottom side LED element, at least one right side LED element, and at least one left side LED element, the left side LED element extending from the left side of the bottom side LED element to the left side of the top side LED element, the right side LED element extending from the right side of the bottom side LED element to the right side of the top side LED element.

The LED module mounted in the housing for representing an uppercase letter "M" or an uppercase letter "B" further comprises at least one left diagonal LED element and at least one right diagonal LED element positioned within the interior of the plurality of LED elements disposed to form the generally parallelogram perimeter, the left diagonal LED element extending from the left side of the top side LED element toward the center of the plurality of LED element disposed to form the parallelogram perimeter, the right diagonal LED element extending from the right side of the top side LED element toward the center of the plurality of LED element disposed to form the parallelogram perimeter, and at least one interior LED element positioned near the center of the parallelogram perimeter extending toward the right side LED.

The LED module mounted in the housing for representing an uppercase letter "M" or an uppercase letter "B" further comprises a series of LED elements configured to provide visual indicia of "ILLION" positioned in the housing and placed immediately to the right of the LED module mounted in the housing for representing an uppercase letter "M" or an uppercase letter "B," wherein the LED module and the series of LED elements provides visual indicia of the words "MILLION" or "BILLION."

In a first preferred embodiment, the at least one left side LED element comprises a top left side LED element and a bottom left side LED element, the top left side LED element collinear with the bottom left side element, the top left side LED element positioned above the bottom left side LED element. The at least one right side LED element preferably comprises a top right side LED element and a bottom right side LED element, the top right side LED element collinear with the bottom right side element, the top right side LED element positioned above the bottom right side LED element. The at least one interior LED element preferably has a generally vertical arm extending from near the at least one bottom LED element to near the at least one top LED element, the at least one interior LED element having a right horizontal arm extending from the center of the parallelogram perimeter to near the top and bottom right LED elements.

The at least one interior LED element preferably further comprises a protrusion extending from the center of the parallelogram perimeter to the right, wherein the protrusion does not extend to the top and bottom left LED element. The at least one leftmost side LED element preferably comprises a left, collinear vertical stack of "m" discrete LEDs, where "m" is an integer, the at least one rightmost side LED element comprises a right, collinear vertical stack of "m" discrete LEDs, the at least one top side LED element comprises a top horizontal row of "n" discrete LEDs, where "n" is an integer, the at least one bottom side LED element comprises a bottom horizontal row of "n" discrete LEDs, the at least one interior LED element comprise a middle horizontal row of "n" discrete LEDs, the at least one left diagonal LED element comprises one or more left diagonal discrete LEDs, and the at least one right diagonal LED element comprises one or more right diagonal discrete LEDs.

The illuminated display preferably, further comprising one or more seven segment light emitting diode ("LED") modules mounted in the housing and configured to provide a visible indicia of numerals. The illuminated display preferably further comprising a nine segment LED module configured to display indicia of numerals and indicia of an uppercase letter "B." The illuminated display preferably further comprising a transparent backlight panel extending across the front surface of the housing unit, and a replaceable graphic overlay placed on the front surface of the housing unit, the replaceable graphic overlay configured to be backlit by the backlight panel, the graphic overlay having visible indicia.

In a second aspect, an illuminated display for displaying a lottery jackpot value in the range of millions and billions of currency is disclosed. The display comprises a flat housing unit having a front surface, and an LED module mounted in the housing for representing an uppercase letter "M" or an uppercase letter "B" comprising two substantially horizontal and elongated LED line segments including a top and bottom horizontal line segments, two aligned, substantially vertical, collinear and elongated LED line segments positioned immediately to the left of the top and bottom horizontal line segments comprising a top left vertical line segment and a bottom left vertical line segment, two aligned, substantially vertical, collinear and elongated LED line segments positioned on the right of the top and bottom horizontal line segments comprising a top right vertical line segment and a bottom right vertical line segment, an interior LED element positioned between the top and bottom horizontal line segments, the interior LED element shaped as an asymmetrical cross having a generally vertical arm centered and parallel with the top right vertical line segment and a bottom right vertical line segment, the generally vertical arm extending from near the bottom horizontal line segment to near the top horizontal line segment, the interior LED having a right horizontal arm extending from the vertical center of the vertical arm toward the right with a distal end adjacent to the top right vertical line segment and the bottom right vertical line segment.

The display further comprises a left diagonal elongated LED line segment extending from the interior LED element to the left side of the top horizontal line segment, and a right diagonal elongated LED line segment extending from the interior LED element to the right side of the top horizontal line segment, and a series of LED elements configured to provide visual indicia of "ILLION" positioned in the housing and placed immediately to the right of the LED module mounted in the housing for representing an uppercase letter "M" or an uppercase letter "B," wherein the LED module and the series of LED elements provides visual indicia of the words "MILLION" or "BILLION."

In a second preferred embodiment, the display further comprises a left horizontal protrusion extending from the vertical center of the vertical arm toward the left, where the horizontal length of the right horizontal arm is larger than the horizontal length of the left horizontal protrusion. The illuminated display preferably further comprises one or more seven segment light emitting diode ("LED") modules mounted in the housing and configured to provide a visible indicia of numerals. The illuminated display preferably further comprising a nine segment LED module configured to display indicia of numerals and indicia of an uppercase letter "B."

The illuminated display preferably, further comprising a transparent backlight panel extending across the front surface of the housing unit, and a replaceable graphic overlay placed on the front surface of the housing unit, the replaceable graphic overlay configured to be backlit by the backlight panel, the graphic overlay having visible indicia. The illuminated display preferably further comprises three alphanumeric LED modules configured to display indicia of a day of a week.

In a third aspect, an illuminated display for displaying a lottery jackpot value in the range of millions and billions of currency is disclosed. The display comprises a flat housing unit having a front surface, and an LED module mounted in the housing for representing an uppercase letter "M" or an uppercase letter "B" having a plurality of LEDs arranged generally in a partially populated m×n matrix form having m rows in a horizontal direction and n columns in a vertical direction, wherein m and n are integers, the plurality of LEDs comprising a top horizontal row of LEDs placed at the $m^{th}$ row of the matrix, the top horizontal row fully populated with LEDs from the first column to the $n^{th}$ column, a middle horizontal row of LEDs placed at the middle row of the matrix, the middle horizontal row fully populated with LEDs from the first column to the $n^{th}$ column, a bottom horizontal row of LEDs placed at the first row of the matrix, the bottom horizontal row fully populated with LEDs from the first column to the $n^{th}$ column, a left vertical column of LEDs placed at the first column of the matrix, the left vertical column fully populated with LEDs from the first row to the $m^{th}$ row, a right vertical column of LEDs placed at the $n^{th}$ column of the matrix, the right vertical column fully populated with LEDs from the first row to the $m^{th}$ row, a left diagonal series of LEDs emerging diagonally from the $m^{th}$ row, first column to the center of the matrix, the left diagonal series of LEDs fully populated, a right diagonal series of LEDs emerging diagonally from the $m^{th}$ row, $n^{th}$ column to the center of the matrix, the right diagonal series of LEDs fully populated, wherein the matrix positions not listed in the plurality of LEDs are unpopulated having no LED, and, a series of LED elements configured to provide visual indicia of "ILLION" positioned in the housing and placed immediately to the right of the LED module mounted in the housing for representing an uppercase letter "M" or an uppercase letter "B," wherein the LED module and the series of LED elements provides visual indicia of the words "MILLION" or "BILLION."

In a third preferred embodiment, the integers "m" and "n" are odd numbered integers, wherein the middle horizontal row is placed the row given by the equation $[(m-1)/2]+1$, and the center of the matrix is positioned on the $\{[(m-1)/2]+1\}$ row and the $\{[(n-1)/2]+1\}$ column. The integers "m" and "n" preferably each have a value of 5, wherein: the top horizontal row of LEDs placed at the 5th row of the matrix, the top horizontal row fully populated with LEDs positioned in the first, second, third, fourth, and fifth columns, the middle horizontal row of LEDs placed at the 3rd row of the matrix, the middle horizontal row fully populated with LEDs positioned in the first, second, third, fourth, and fifth columns, a bottom horizontal row of LEDs placed at the first row of the matrix, the bottom horizontal row fully populated with LEDs positioned in the first, second, third, fourth, and fifth columns, a left vertical column of LEDs placed at the first column of the matrix, the left vertical column fully populated with LEDs in the first, second, third, fourth, and fifth rows, a right vertical column of LEDs placed at the 5th column of the matrix, the right vertical column fully populated with LEDs in the first, second, third, fourth, and fifth rows, a left diagonal series of LEDs emerging diagonally from the 5th row, first column to the center of the matrix, the left diagonal series of LEDs populated in first column and the fifth row, the second column and fourth row, and third column and the third row, a right diagonal series of LEDs emerging diagonally from the 5th row, 5th column to the center of the matrix, the right diagonal series of LEDs fully populated in 5th column and the fifth row, the fourth column and fourth row, and third column and the third row, and the matrix positions of the 3rd column and fourth row, the 2nd column and second row, the 3rd column and 2nd row, and the 4th column and 2nd row are unpopulated having no LED.

The illuminated display preferably further comprising one or more seven segment light emitting diode ("LED") modules mounted in the housing and configured to provide a visible indicia of numerals. The illuminated display preferably, further comprising a nine segment LED module configured to display indicia of numerals and indicia of an uppercase letter "B." The illuminated display preferably comprises a transparent backlight panel extending across the front surface of the housing unit, and a replaceable graphic overlay placed on the front surface of the housing unit, the replaceable graphic overlay configured to be backlit by the backlight panel, the graphic overlay having visible indicia. The illuminated display preferably, further comprising three alphanumeric LED modules configured to display indicia of a day of a week.

These and other features and advantages of the invention will become more apparent with a description of preferred embodiments in reference to the associated drawings.

DETAILED DESCRIPTION OF THE PREFERRED EMBODIMENTS

Figure 1:
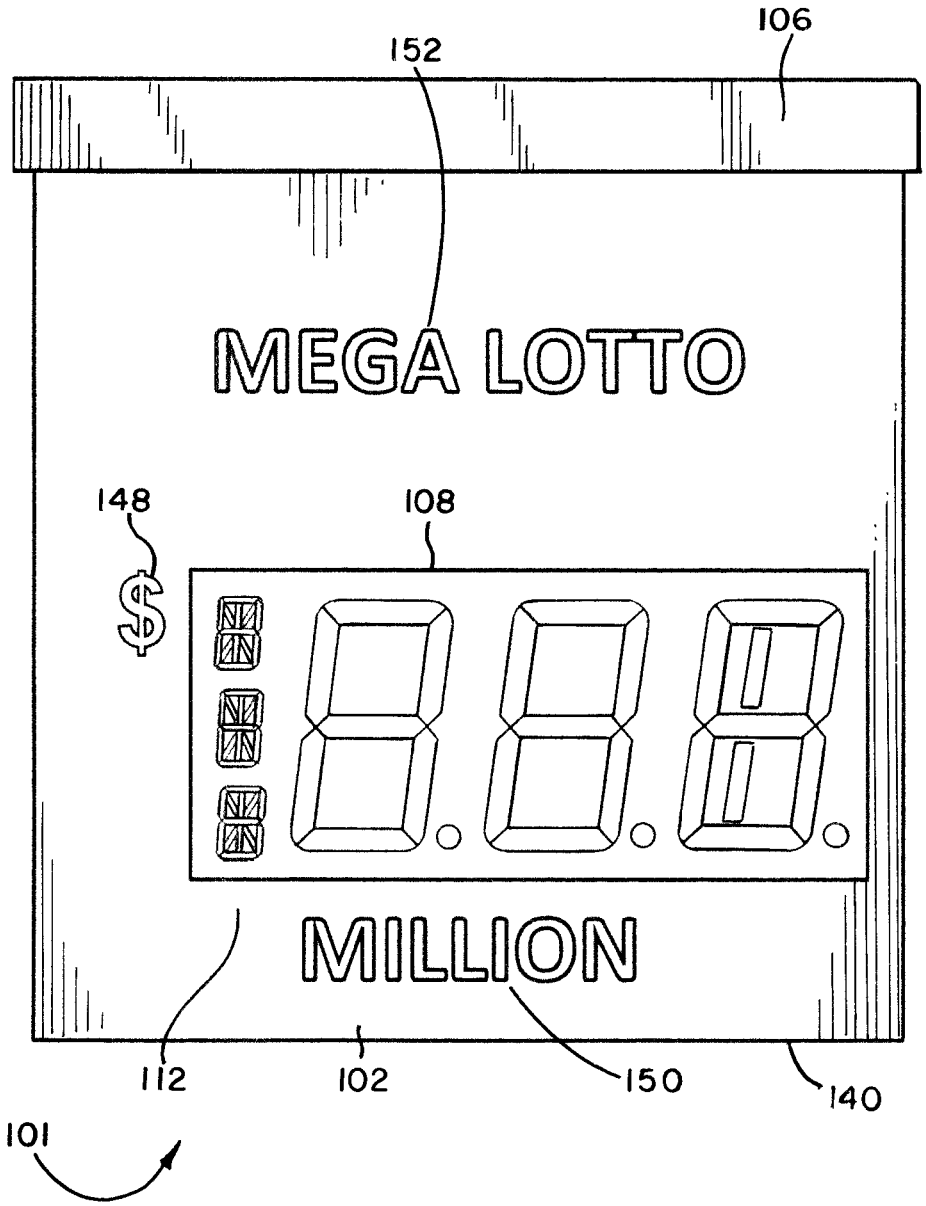
FIG. 1 is a front view of a lottery sign in one or more embodiments.

Government operated lotteries exist in over 40 U.S. states, as well as in over 100 countries in the world. The proceeds from the lotteries are used to supplement governmental revenues, and may be used for various causes such as for education, economic development programs, facility improvements, and tax relief, for example. Consumers may purchase lottery tickets from many convenience stores, gas stations, and supermarkets.

Many of the venues for purchasing lottery tickets may use electronic signs which indicate the current lottery jackpot, as well as the day of the week for the next draw. Many consumers may be persuaded to purchase lottery tickets when the lottery jackpot is large or near record amounts. Currently, lottery jackpots may exceed hundreds of millions of dollars, but are expected to surpass one billion dollars at some point. Many conventional lottery signs are unable to indicate jackpots of one billion dollars or more unambiguously. For example, one approach for indicating a billion dollar jackpot may form a lowercase letter "b" on a conventional seven segment LED. However, this approach is unacceptable as many consumers may misinterpret the symbol as a "6" instead of a "b."

An illuminated display for displaying a lottery jackpot value in the range of millions and billions of dollars is contemplated in one or more embodiments. In an embodiment, a lottery display comprises a string of three LED modules positioned next to each other, where the leftmost LED module indicates the hundreds place for a jackpot value, the center LED module indicates the tens place, and the rightmost LED module indicates the ones place for the jackpot. Conventional LED modules having seven segments may be employed for the indicia of the hundreds and tens values. A special LED module having nine segments may be employed for the indicia of units, where the LED module may be illuminated to form the numerals 0 through 9, as well as an upper case letter "B." The LED module with nine segments is based on the conventional seven segment LED module but uniquely includes two additional vertical segments, which, when lit, with certain other segments will form an unambiguous uppercase letter "B." In one or more embodiments, the uppercase letter "B" may blink to indicate that the jackpot exceeds 1 billion dollars.

Teachings relating to the illuminated display signs disclosed in U.S. patent application Ser. No. 13/436,719 filed Mar. 30, 2012 entitled "ADJUSTABLE ILLUMINATED LOTTERY SIGN" which issued as U.S. Pat. No. 8,826,572 on Sep. 9, 2014 may be employed herein and the disclosure of which is incorporated herein by reference in its entirety.

Embodiments described herein describe lotteries with jackpots listed in dollars. However, it shall be understood that lottery displays depicting other currencies are contemplated in one or more embodiments. Embodiments described herein make reference to LED modules having several line segments as well as to multiple discrete LEDs positioned to form the shape of numerals and letters. It shall be understood that the teachings of LED segmented displays and discrete LEDs are interchangeable, and may be applied to other forms of segmented displays or groups of discrete LED devices.

FIG. 1 is a front view of an illuminated lottery display 101 in one or more embodiments. The illuminated display 101 has a flat housing 102 held in place by a frame 106. The housing 102 has a set of light emitting arrays 108. The light emitting array 108 is depicted as segmented LED modules. However, it shall be understood that either segmented or discrete LEDs may be employed in one or more embodiments.

Figure 2:
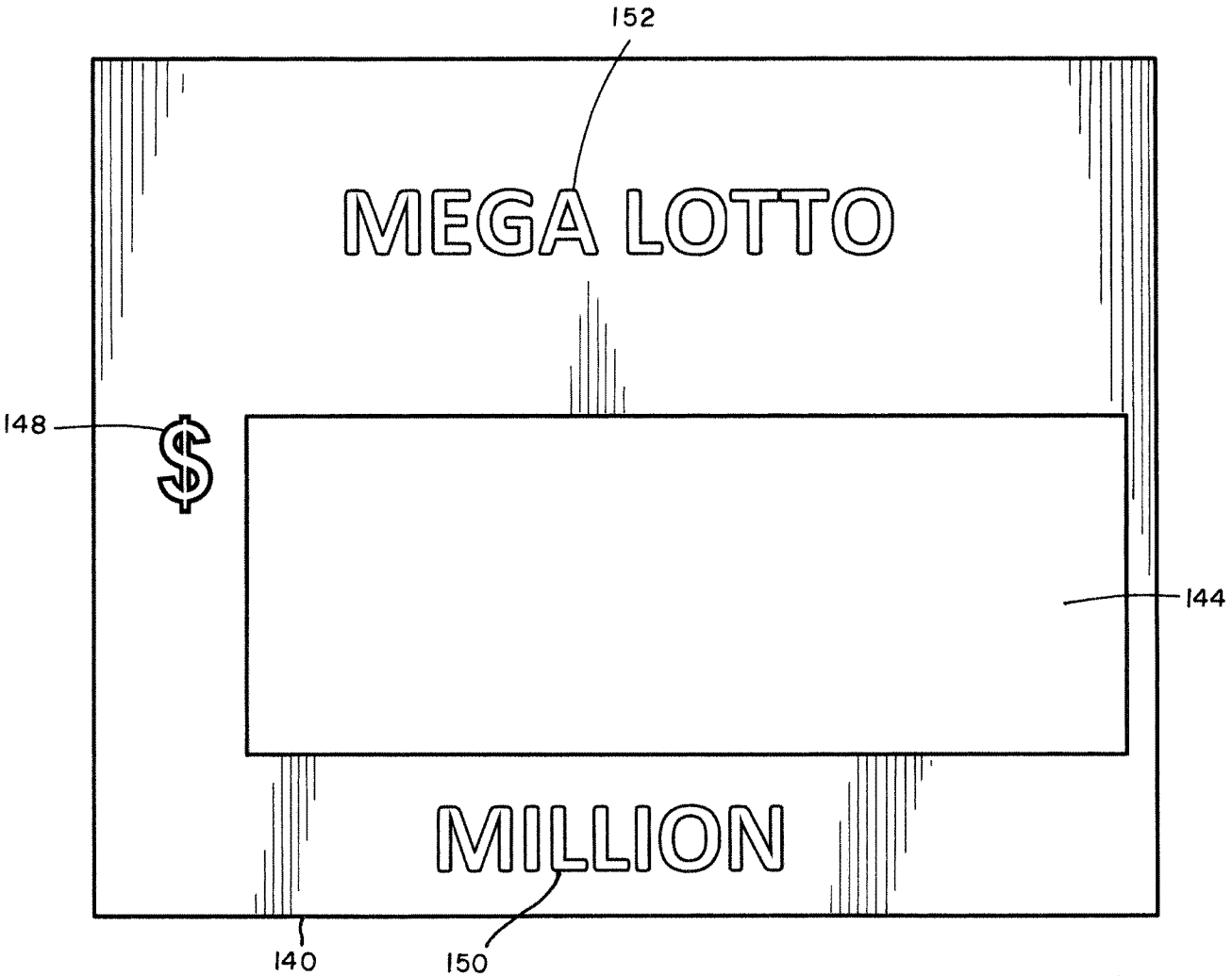
FIG. 2 is a front view of the graphic overlay.

As illustrated in FIG. 2, a graphic overlay 140 is placed over the housing 102. As illustrated in FIG. 2, the graphic overlay 140 has a logo 152, illustrated here as "MEGA LOTTO," as well as visual indicia of currency 148, illustrated here as a dollar sign ("$"), and visual indicia for "MILLION" 150. The graphic overlay 140 has a window 144 for passing the light from the light emitting array 108. In one or more embodiments, the window may be color tinted.

Figure 3:
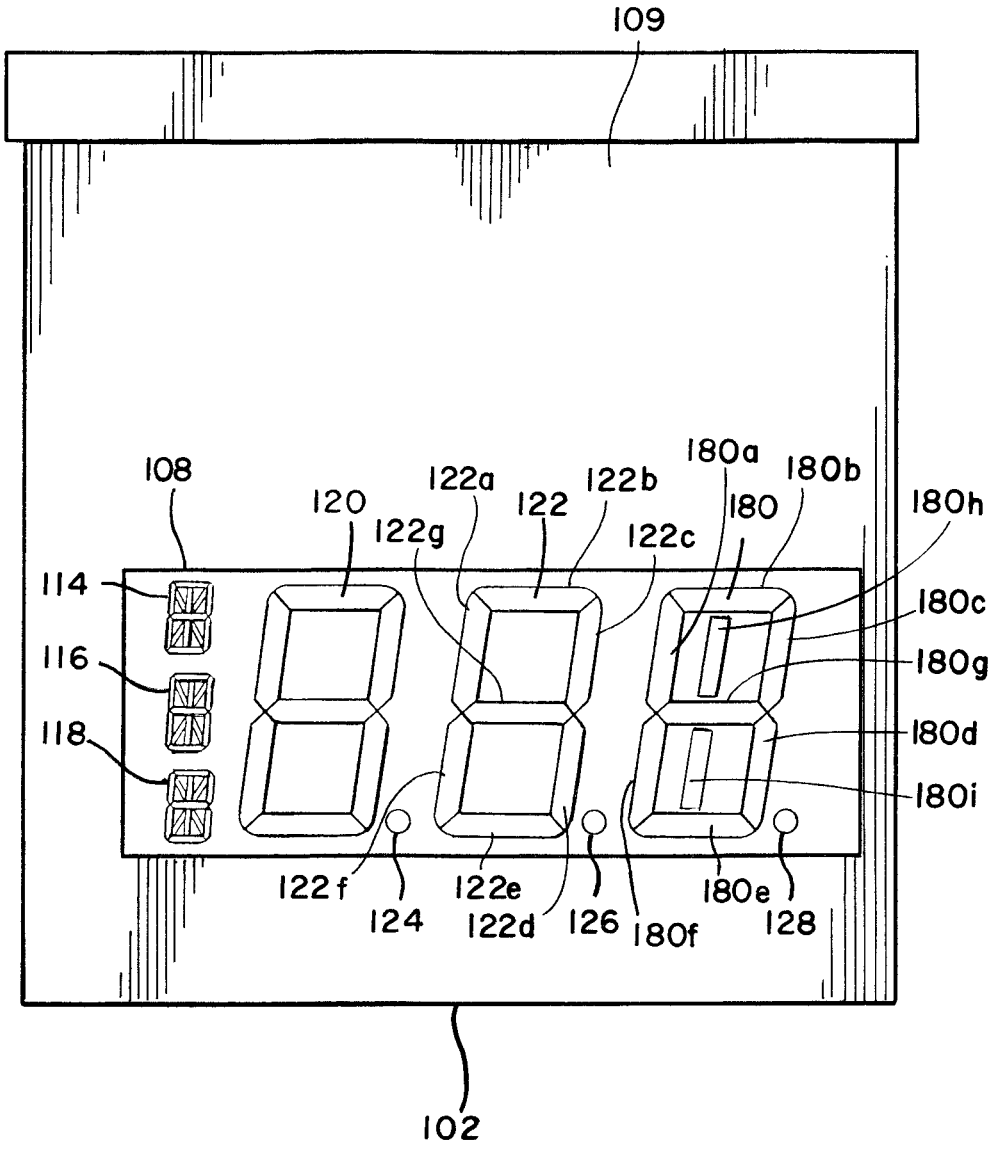
FIG. 3 is a front view of the lottery sign with the overlay removed.

FIG. 3 is a front view of the lottery sign with the graphic overlay 140 removed. The housing 102 has a transparent backlight panel 109. The backlight panel 109 extends across the front surface of the housing unit 102 and emits light which is projected through the graphic overlay panel 140.

The preferred light emitting array 108 comprises three alphanumeric LED modules 114, 116, and 118. In one or more embodiments, LED modules 114, 116, and 118 each have 13 line segments. These three LED modules 114, 116, and 118 may be employed to indicate a day of the week such as the day of the next lottery draw. The modules 114, 116, and 118 may be selectively illuminated to vertically form the visual indicia for "MON," "TUE," "WED," "THU," "FRI," "SAT," or "SUN."

Light emitting array 108 also has three LED modules 120, 122, and 180 positioned next to each other. The leftmost LED module 120 nominally provides indicia of the hundreds place for the jackpot value, the center LED module 122 nominally provides indicia of the tens place, and the rightmost LED module 180 nominally provides indicia of the units value of the jackpot. The light emitting array 108 also has a first, second, and third decimal points 124, 126, and 128 such that the leftmost LED module 120 or the center LED module 122 may nominally provide indicia of the units value of the jackpot.

Both the leftmost and center LED modules 120 and 122 have seven line segments for displaying numerals 0 through 9. For example, LED module 122 has seven segments 122*a*, 122*b*, 122*c*, 122*d*, 122*e*, 122*f*, and 122*g* positioned to form a figure "8" for displaying numerals 0 through 9. The LED module 180, however, uniquely has nine segments comprising seven segments 180*a*, 180*b*, 180*c*, 180*d*, 180*e*, 180*f*, and 180*g* forming a figure "8," as well as two interior vertical segments 180*h* and 180*i* that are substantially vertical and, preferably, shifted slightly left of center. In one or more embodiments, the seven segments 180*a*-180*g* of the LED module 180 are sized and positioned identical to that of the seven segments 122*a*-122*g* of the LED module 122. As such, the numerals displayed by the LED modules 120 and 122 having seven segments will appear identical to the numerals displayed by the LED module 180 having nine segments.

In addition to displaying numerals 0 through 9, by virtue of the two interior vertical segments 180*h* and 180*i*, LED module 180 is also uniquely configured to display an uppercase letter "B" when segments 180*b*, 180*c*, 180*d*, 180*e*, 180*g*, 180*h*, and 180*i* are energized. Hence, LED module 180 may be energized to display numerals 0 through 9 as well as an uppercase letter "B."

In one or more embodiments, the arrangement of having LED modules 120, 122, and 180, along with the decimal points 124, 126, and 128 enable the light emitting array 108 to generate values ranging from 0.01 (i.e., 0.01 million) through 99 B (i.e., 99 billion). Hence, this light emitting array 108 may display jackpot values having a range of almost seven orders of magnitude (i.e., almost seven decades of jackpot values).

Figure 4:
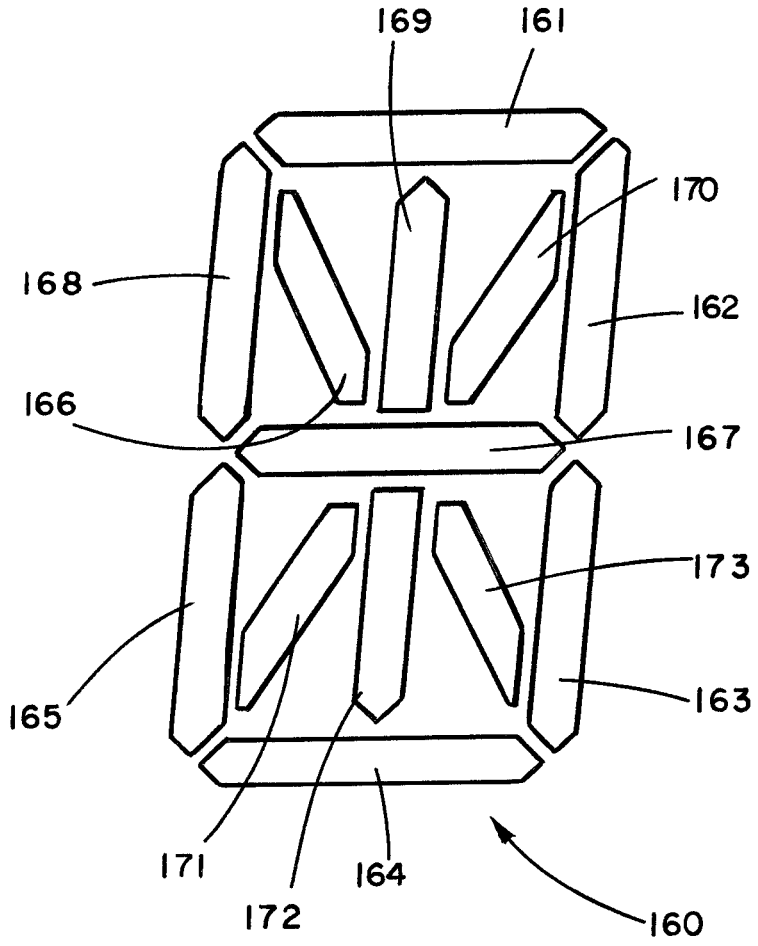
FIG. 4 is a front view of an LED module having 13 segments.

FIG. 4 is a front view of an LED module 160 having 13 segments. The LED module 160 is comprised of four vertical segments 162, 163, 165, and 168 and three horizontal segments including a top horizontal segment 161, a middle horizontal segment 167, and a bottom horizontal segment 164, the seven LED segments 161, 162, 163, 164, 165, 168, and 167 forming a figure "8." The LED module 160 also has a first interior vertical segment 172 extending from the center of the bottom horizontal segment 164 toward the center of the middle horizontal segment 167, and a second vertical segment 169 extending from the center of the middle horizontal segment 167 toward the center of the top horizontal segment 161. The first and second interior vertical segments 164 and 169 are positioned collinear with each other and parallel with the four vertical segments 162, 163, 165, and 168. The LED module 160 also has 4 additional segments 166, 170, 173, and 171 extending from the center region of the middle horizontal segment 167. Segment 166 extends toward the upper left corner formed by segments 168 and 161, segment 170 extends toward the upper right corner formed by segments 161 and 162, segment 173 extends toward the lower right corner formed by segments 163 and 164, and segment 171 extends toward the lower left corner formed by segments 164 and 165.

The LED module 160 of FIG. 4 is useful for displaying the letters for the 3-character abbreviations for the days of the week (MON, TUE, WED, THU, FRI, SAT, and SUN), but it includes many more segments than are necessary when the main goal is to simply display the numerals 0 to 9. Moreover, trying to display a capital letter "B" by illuminating the segments corresponding to 3, along with the centered segments 169, 172, does not unambiguously appear like a capital letter B.

Figure 5:
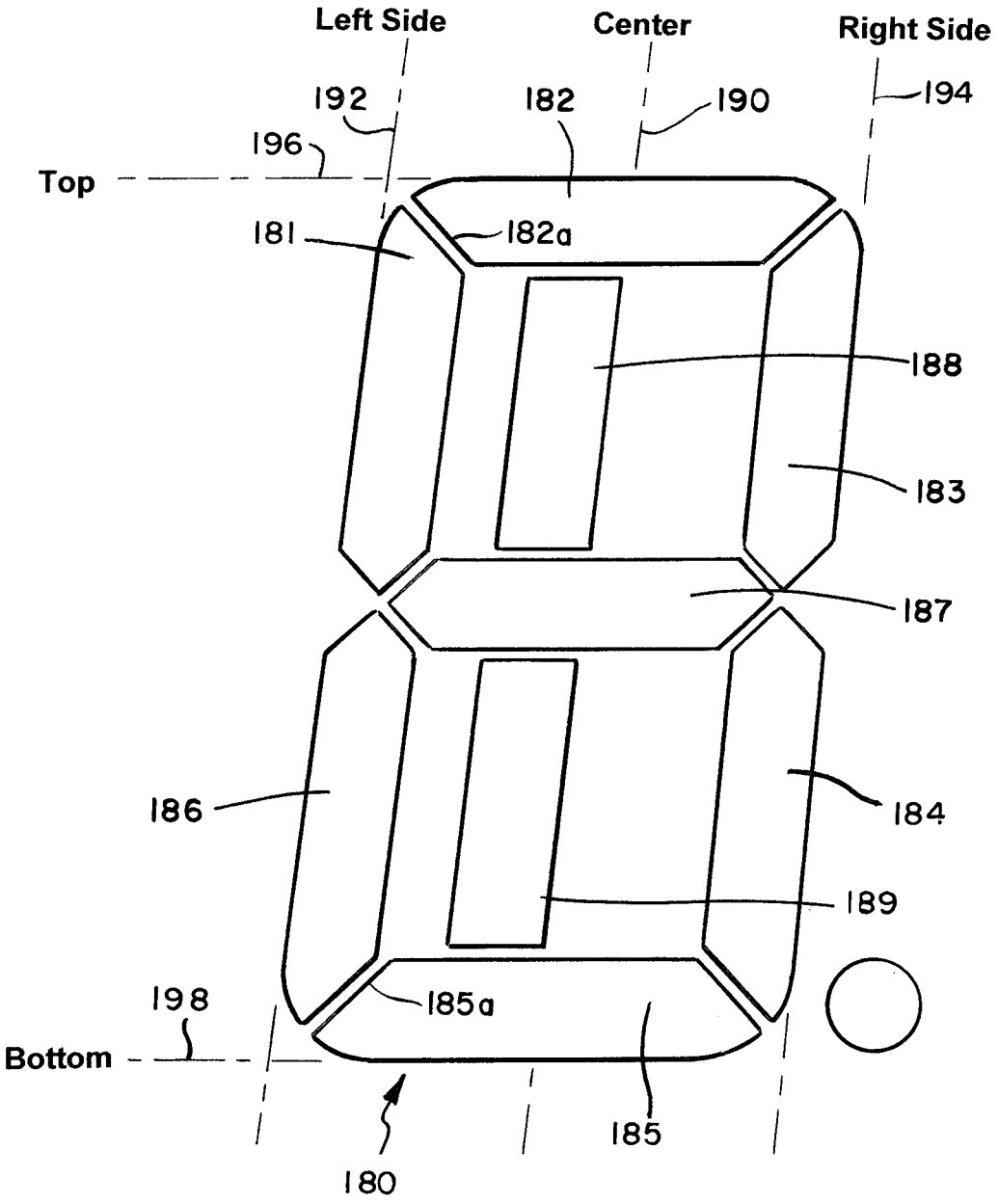
FIG. 5 is a front view of an LED module having 9 segments.

FIG. 5 is a front view of an LED module 180 having only 9 line segments. The nine segment LED module 180 comprises seven LED line segments 181, 182, 183, 184, 185, 186, and 187 having four vertical line segments 181, 186, 183, and 184 and three horizontal line segments 182, 187, and 185 including a top horizontal line segment 182, a middle horizontal line segment 187, and a bottom horizontal line segment 185 where seven LED line segments 181-187 form a figure "8". The nine segment LED module 180 further comprises a first interior vertical line segment 189 extending from the bottom horizontal line segment 185 to the middle horizontal line segment 187, and a second vertical line segment 188 extending from the middle horizontal line segment 187 to the top horizontal line segment 182. The first interior vertical line segment 189 and second interior vertical line segment 188 are positioned collinear with each other, parallel with the four vertical line segments 181, 186, 183, and 184, and slightly left of center.

In other words, the nine segment LED module 180 comprises three substantially horizontal discrete and elongated LED line segments 182, 187, and 185 including an upper horizontal line segment 182, a middle horizontal line segment 187, and a lower horizontal line segment 185. The LED module 180 has a left side marked by line 192, a center line marked by line 190, a right side marked by line 194, a top marked by line 196, and a bottom marked by line 198.

Two aligned, substantially vertical line segments 181 and 186 are positioned on the left of the upper horizontal line segment 182, the middle horizontal line segment 187, and the lower horizontal line segment 185 comprising a top left vertical line segment 181 and a bottom left vertical line segment 186. The top left vertical line segment 181 extends from the left end of the middle horizontal line segment 187 to the left end of the upper horizontal line segment 182. The bottom left line segment 186 extends from the left end of the middle horizontal line segment 187 to the left end of the lower horizontal line segment 185.

Two aligned, substantially vertical line segments 183 and 184 are positioned on the right of the upper horizontal line segment 182, the middle horizontal line segment 187, and the lower horizontal line segment 185 comprise a top right vertical line segment 183 and a bottom right vertical line segment 184. The top right vertical line segment 183 extends from the right end of the middle horizontal line segment 187 to the right end of the upper horizontal line segment 182. The bottom right line segment 184 extends from the right end of the middle horizontal line segment 187 to the right end of the lower horizontal line segment 185.

The LED module 180 also has two aligned, substantially vertical interior line segments 188 and 189 positioned to the left of the centers of the upper horizontal line segment 182, the middle horizontal line segment 187, and lower horizontal line segment 185 comprising a top interior vertical line segment 188 and a bottom interior vertical line segment 189. The top interior vertical line segment 188 extends from left of the center of the middle horizontal line segment 187 to the left of the center of the upper horizontal line segment 182. The bottom interior line segment 189 extends from the left of the center of the middle horizontal line segment 187 to the left of the center of the lower horizontal line segment 185.

In one or more embodiments, the line segments may have bevels formed for enhancing the quality of the display. For example, the upper horizontal line segment 182 has a beveled edge 182*a* and the lower horizontal line segment 185 has a beveled edge 185*a*. In one or more embodiments, the beveled edges 182*a* and 185*a* provide an illusion to a user that the top and bottom horizontal line segment 182 and 185 is connected to the vertical interior line segments 188 and 189 which may enhance the visual quality of the uppercase letter "B."

Figure 6:
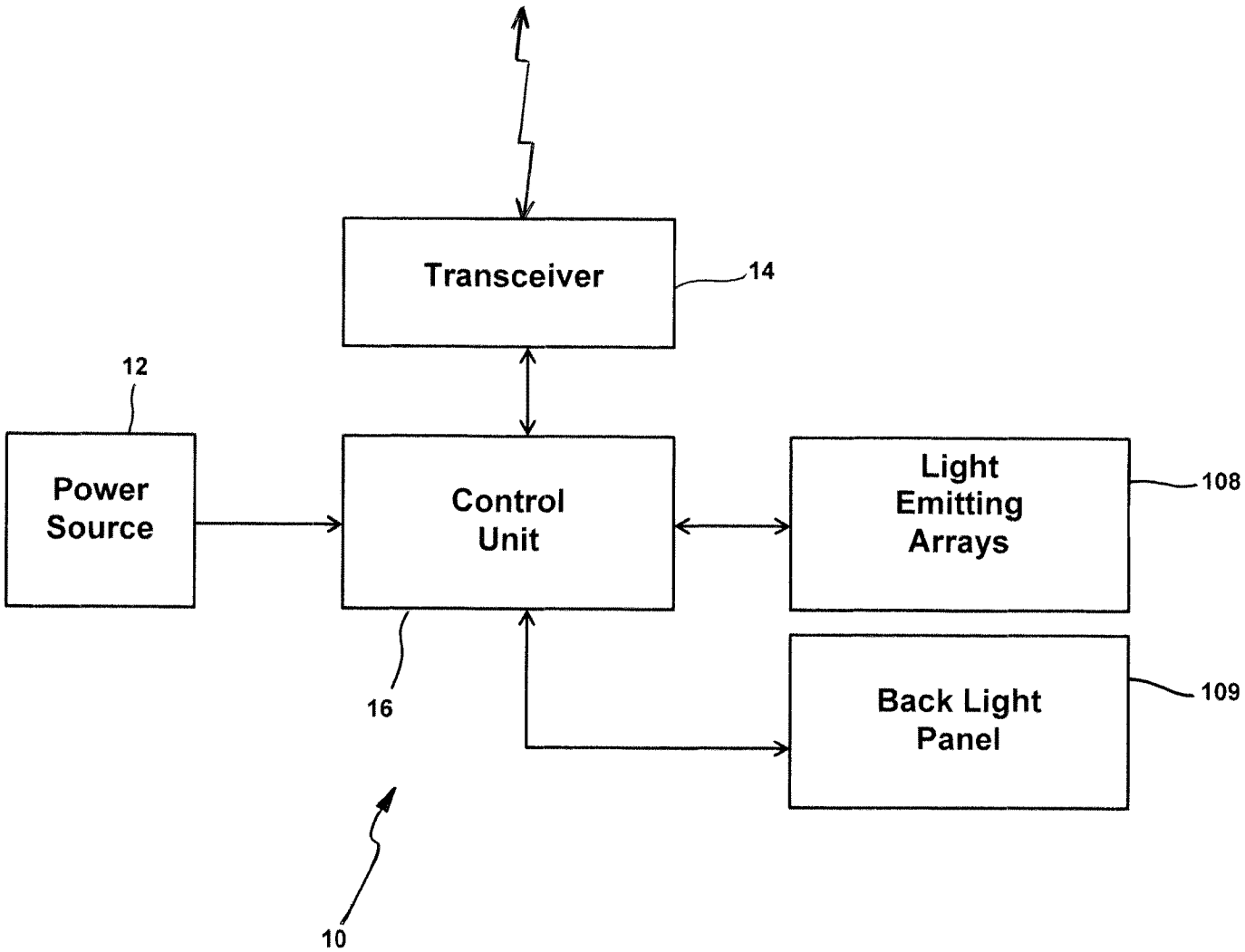
FIG. 6 is a schematic, block diagram of a circuit for controlling the illuminated sign.

FIG. 6 is a schematic, block diagram of a circuit 10 for operating the illuminated sign 101. The circuit 10 has a power source 12, a control unit 16 (i.e. a controller), a transceiver 14, as well as the light emitting array 108, and backlight panel 109. The power source 12 provides power to the controller 16, the transceiver 14, the light emitting array 108, and the backlight panel 109. The control unit 16 receives and transmits data via the transceiver 14. The control unit 16 also controls the light emitting array 108, as well as the backlight panel 109. The control unit 16 may receive information such as the current jackpot value and the day of the draw, and then selectively energize LED segments or discrete LEDs in the light emitting arrays to provide visual indicia of status of the current lottery jackpot.

Figure 7:
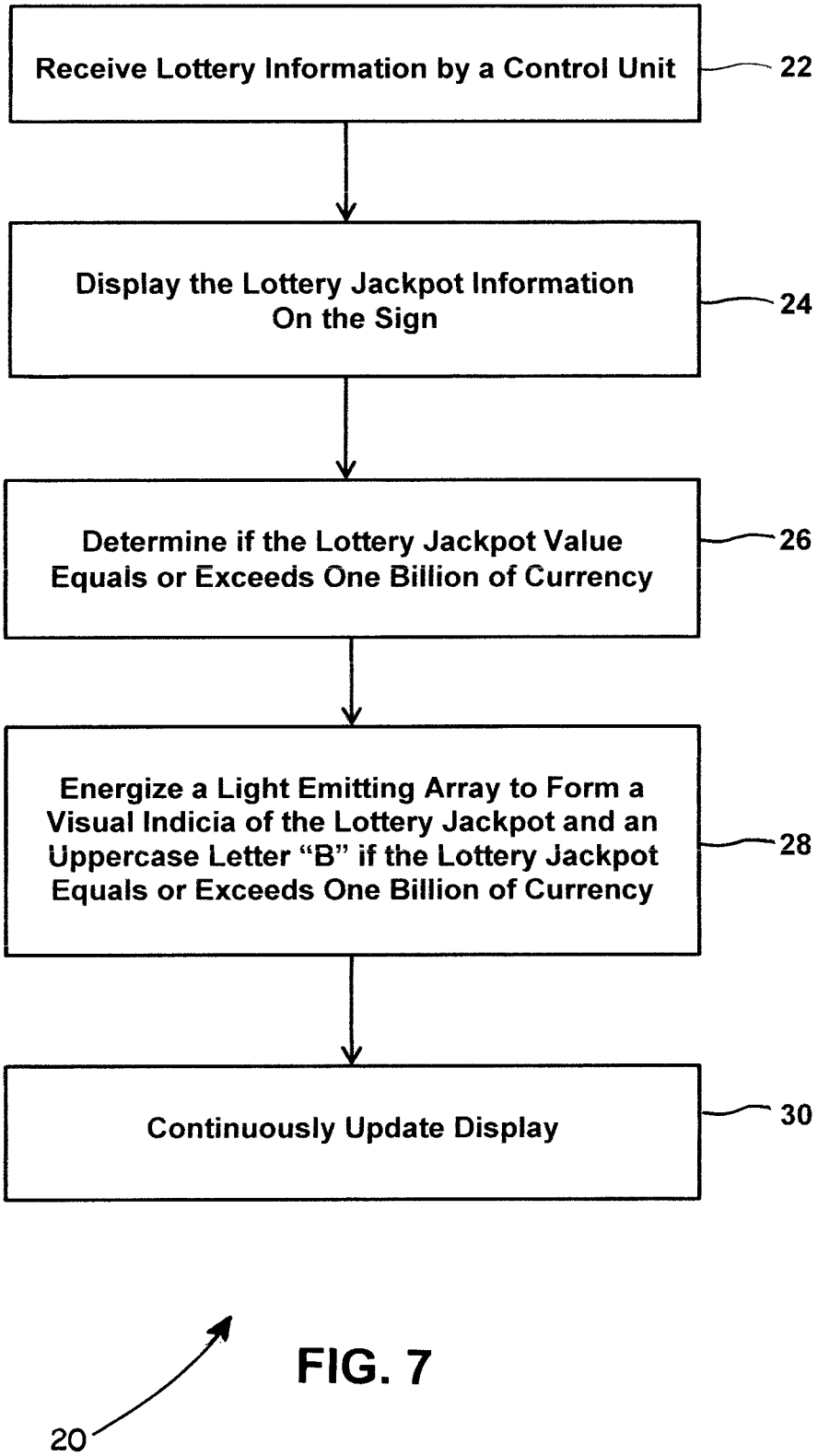
FIG. 7 is a flowchart of an exemplary process for controlling the illuminated sign.

FIG. 7 is an exemplary flowchart illustrating an exemplary process 20 for displaying lottery information on a sign 101. Lottery information is received by a control unit 16 via a transceiver 14 in an embodiment (step 22). The control unit 16 interprets the lottery information and displays the lottery jackpot information on the sign 101 (step 24). The control unit 16 determines if the lottery jackpot value equals or exceeds one billion of currency (step 26). If the lottery jackpot equals or exceeds one billion of currency, the control unit 16 energizes one or more of the light emitting arrays 108 or 110 to form a visual indicia of the lottery jackpot and an uppercase letter "B" (step 28). The control unit 16 continuously receives information via the transceiver 14 and updates the display (step 30).

Figure 8:
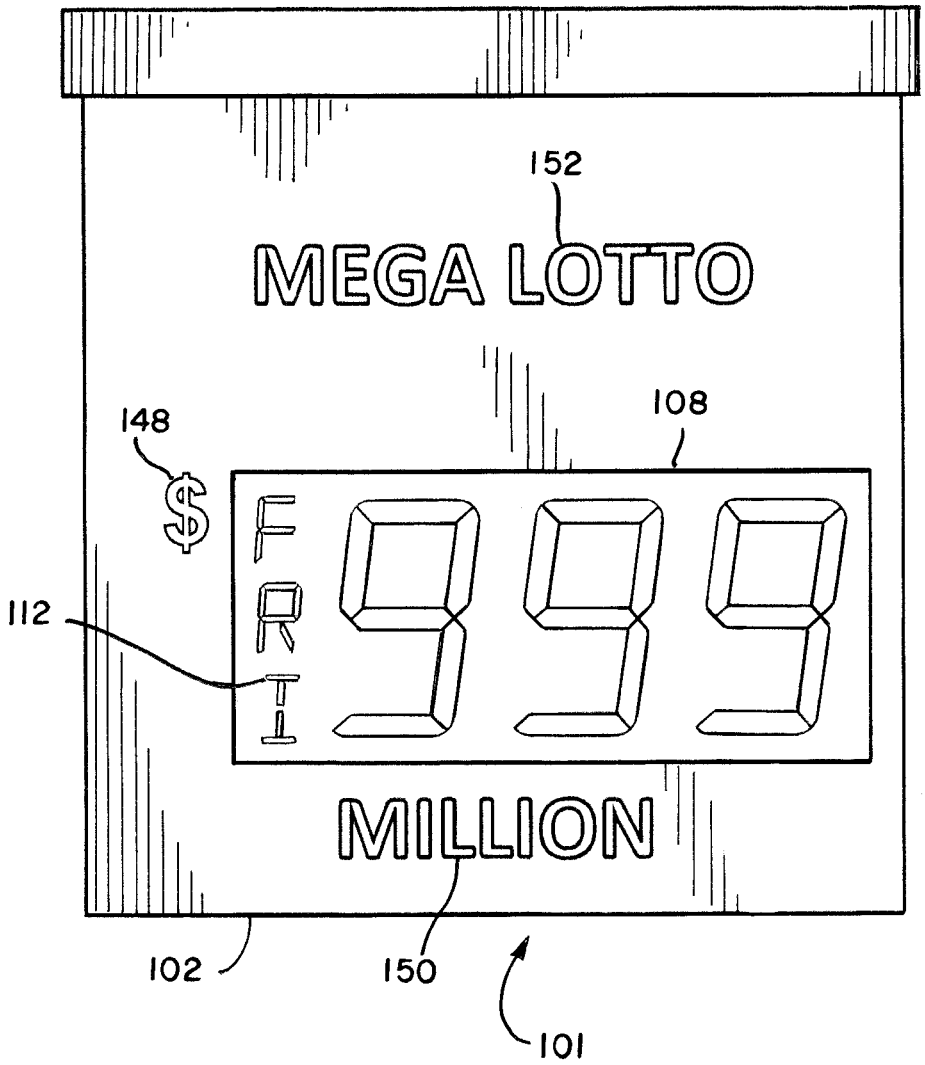
FIG. 8 is a front view of the lottery sign indicating that the lottery jackpot is 999 million dollars.
Figure 9:
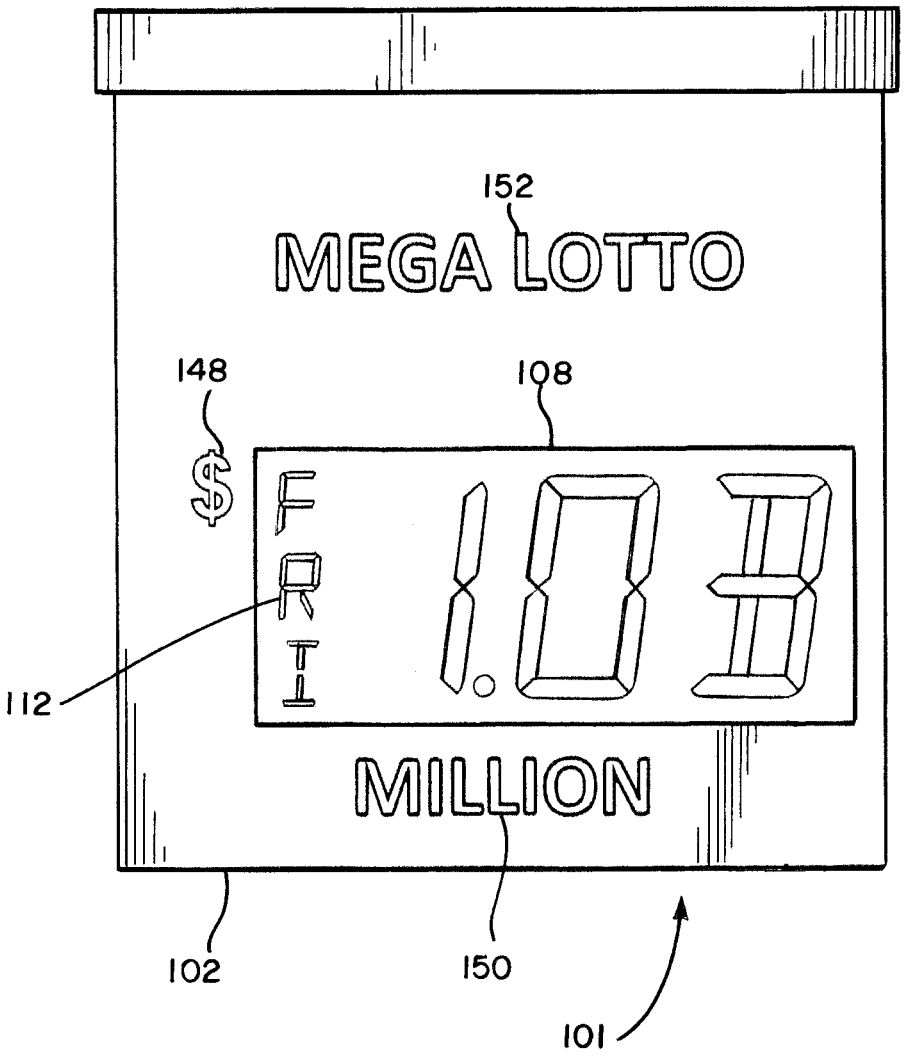
FIG. 9 is a front view of the lottery sign indicating that the lottery jackpot is 1 billion dollars.

FIGS. 8 and 9 are front views of the lottery sign 101 displaying lottery information. The housing 102 has a logo 152 indicating that the lottery is the "MEGA LOTTO," as well as visual indicia for the currency 148, and indicia for "MILLION" 150. The light emitting array 108 has indicia for the day of the draw 112, which is listed as "FRI" for Friday in this example, as well as an illuminated current value of the jackpot of "999." Hence a user would interpret the sign as showing that the MEGA LOTTO has a current jackpot of 999 million dollars, and that the day of the lottery draw is on Friday.

FIG. 9 illustrates the sign 101 when the current jackpot is 1 billion dollars. Here, the light emitting array 108 shows that the current jackpot is "1.0 B." While the indicia for "MILLION" is listed, a user would interpret the displayed value as 1.0 billion dollars as a result of the prominent "B" in the illuminated display. Moreover, users who follow the lottery would realize that the jackpot is growing, and would not interpret the display as indicating 1.0 Million dollars. Moreover, in one or more embodiments, the uppercase letter "B" may blink to indicate the jackpot is in excess of one billion dollars. In one or more embodiments, the uppercase letter "B" is repeatedly and periodically energized and de-energized, causing the uppercase letter "B" to blink and illuminate repeatedly.

Although the invention has been discussed with reference to specific embodiments, it is apparent and should be understood that the concept can be otherwise embodied to achieve the advantages discussed. The preferred embodiments above have been described primarily as electronic lottery signs for displaying jackpots in the millions and billions of dollars. In this regard, the foregoing description of the lottery signs is presented for purposes of illustration and description. It shall be apparent that various displays would benefit from having a display showing millions or billions of dollars.

Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

Lottery signs which may have a fixed currency number scale (i.e., visual indicia of millions or billions of dollars) placed on a graphic overlay may confuse consumers even if an uppercase letter "B" is present elsewhere on the lottery sign. As shown in FIG. 9, the lottery sign 101 indicates that the jack pot is 1.0 Billion Dollars through the use of a special nine-segmented LED display 180 illustrated in FIG. 5. However, the sign 101 has a fixed visual indicia for "MILLION" 150 immediately below the LED arrays 108 displaying "1.0 B." Hence, a person viewing the sign 101 may be confused as to the amount of the jackpot as the sign shows both a "B" displayed in the LED arrays 108, indicating a jackpot in excess of one billion dollars, as well as showing visual indicia indicating the jackpot is in millions of dollars. Hence a need exists for providing an improved currency number scale for indicating "MILLION" or "BILLION."

Conventional alphanumeric LED displays may be employed to address this need; however, conventional alphanumeric LED displays may require 14 or 16 LED segments having many short, truncated segments in order to display a wide range of numbers as well as lowercase and uppercase letters. One drawback to this approach may be that the displayed characters may lack clarity and may be difficult to read. Moreover, the cost of fabricating large LED displays suitable for lottery signs using conventionally segmented designs may be greater than that for special, tailored displays having fewer LED elements.

In one or more embodiments, a currency number scale LED module is employed in which the size and placement of LED elements are tailored to provide a display with substantially enhanced clarity. In one or more embodiments, specially-designed LED displays are employed to display only a limited of characters such as one or two letters. In a preferred embodiment, the display may have the minimum number of LED elements necessary to form a character, and the segments are beveled and closely-positioned such that character display is easily readable.

In one or more embodiments, a lottery sign 101 comprises a currency number scale module comprising of LED arrays which may be illuminated to indicate "MILLION" or "BILLION." In one or more embodiments, an LED module mounted in the housing for representing an uppercase letter "M" or an uppercase letter "B" is placed immediately to the left of a series of LED elements configured to provide visual indicia of "ILLION." The LED module and the series of LED elements provide visual indicia of the words "MILLION" or "BILLION."

As used herein and as is known in the art, the terms LEDs, LED elements, LED segments, and LED modules are used interchangeably herein and may refer to a single discrete LED or a group of LEDs, formed as separate devices or formed on a single or multiple circuit boards for example.

Figure 10:
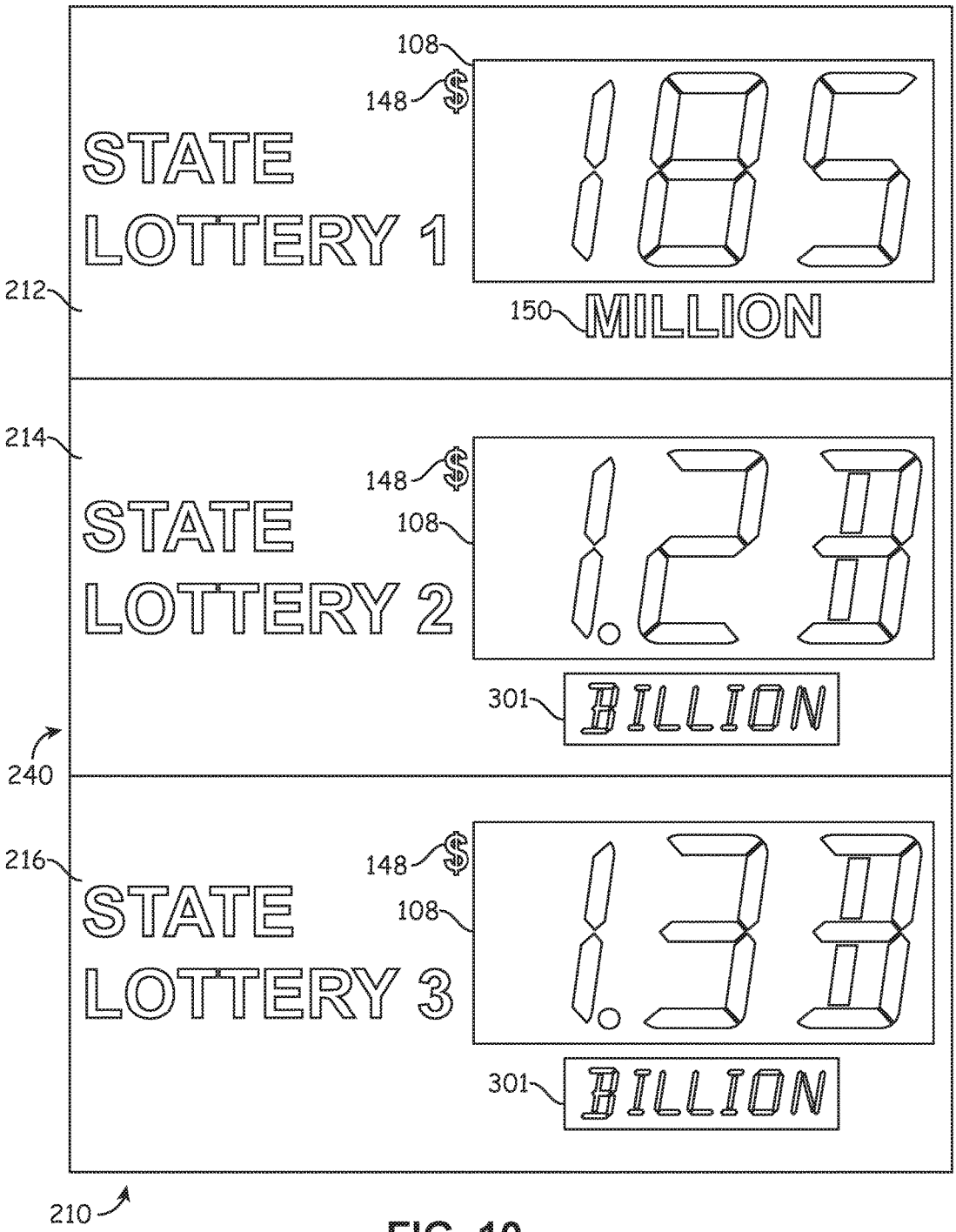
FIG. 10 is a front view of a lottery sign listing the jackpots for three lotteries in one or more embodiments.

FIG. 10 is a front view of an illuminated lottery sign 210 comprising three displays 212, 214, and 216 listing the jackpots for three lotteries in one or more embodiments. The illuminated lottery sign 210 has a graphic overlay 240 placed over a panel holding the components. The top display 212 has a set of light emitting arrays 108 indicating a value of "185" as well as visual indicia of MILLION 150 on the graphic overlay 240 and indicia of a dollar sign 148. Taken together, one would interpret the top sign 212 to read that the current jackpot for "STATE LOTTERY 1" is 185 Million Dollars.

The middle lottery display 214 has similar features as that of lottery display 212 except that the visual indicia of MILLION 150 on the graphic overlay 240 is replaced by a Currency Number Scale LED module 301 which can display either "MILLION" or "BILLION." In this example, the LED module 301 in the middle lottery display 124 is currently displaying "BILLION." Directly above the LED module 301 is a light emitting array 108 which is displaying "1.2 B," and is also indicating that the jackpot is in billions of dollars. Hence, the middle display 214 may be unambiguously interpreted to read that the jackpot is 1.2 Billion Dollars.

The bottom display 216 is similar to the middle display 214 and also has a Currency Number Scale LED module 301 currently displaying "BILLION." The bottom display 216 also has a light emitting array 108 displaying "1.3 B." Hence, the bottom display 216 may be unambiguously interpreted to read that the jackpot is 1.3 Billion Dollars.

Figure 11:
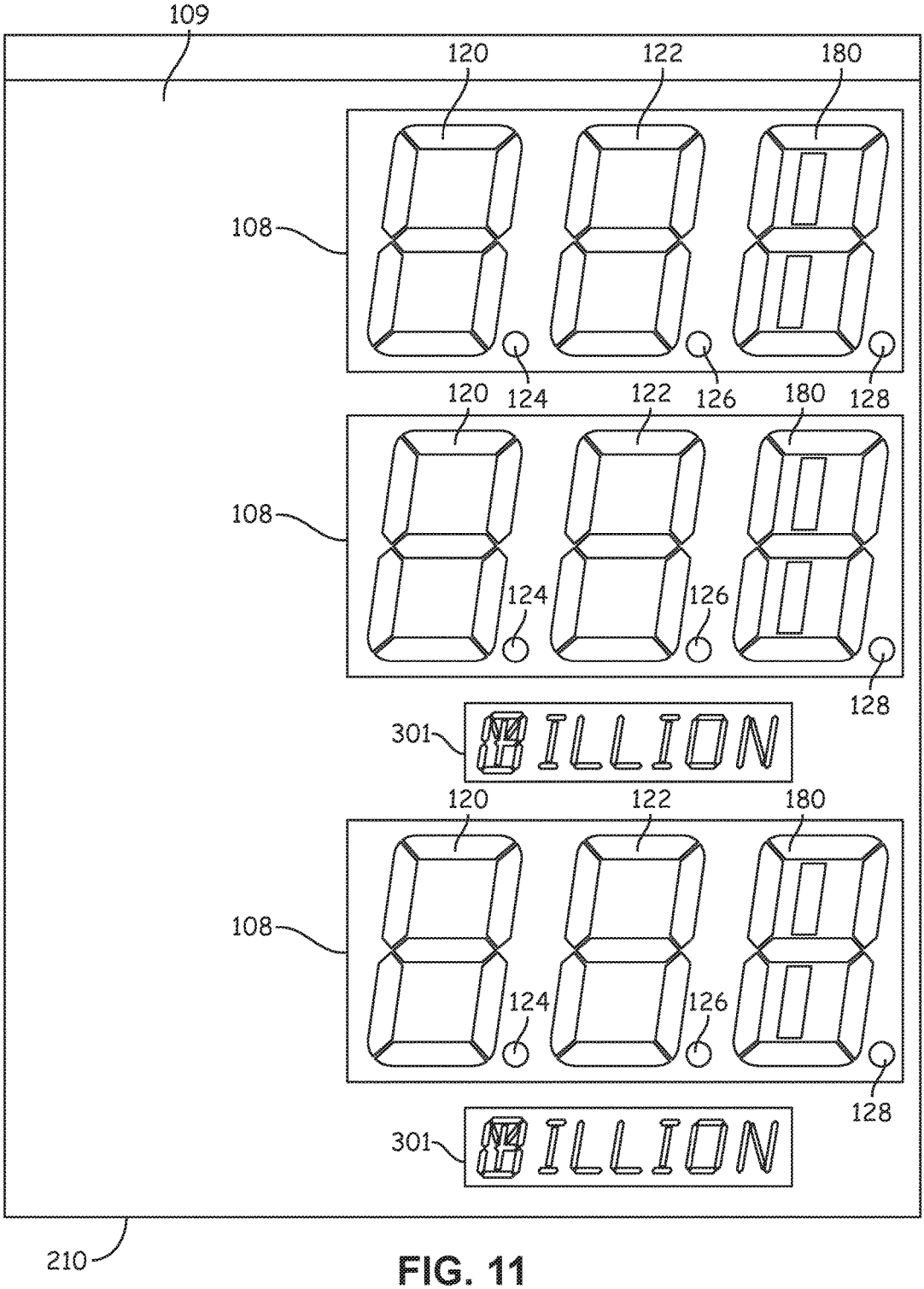
FIG. 11 is a front view of the lottery sign depicted in FIG. 10 with the graphic overlay removed.

FIG. 11 is a front view of the lottery sign 210 depicted in FIG. 10 with the graphic overlay 240 removed. The housing 210 has a transparent backlight panel 109. The backlight panel 109 extends across the front surface of the housing unit 210 and emits light which is projected through the graphic overlay panel 240. Light emitting array 108 also has three LED modules 120, 122, and 180 positioned next to each other. The leftmost LED module 120 nominally provides indicia of the hundreds place for the jackpot value, the center LED module 122 nominally provides indicia of the tens place, and the rightmost LED module 180 nominally provides indicia of the units value of the jackpot. The light emitting array 108 also has a first, second, and third decimal points 124, 126, and 128 such that the leftmost LED module 120 or the center LED module 122 may nominally provide indicia of the units value of the jackpot. The displays also employ the LED module 180 having nine segments which can display the uppercase letter "B," as well as numerals "0," "1," "2," "3," "4," "5," "6," "7," "8," and "9." The lottery sign 210 also illustrates the Currency Number Scale LED module 301.

Figure 12:
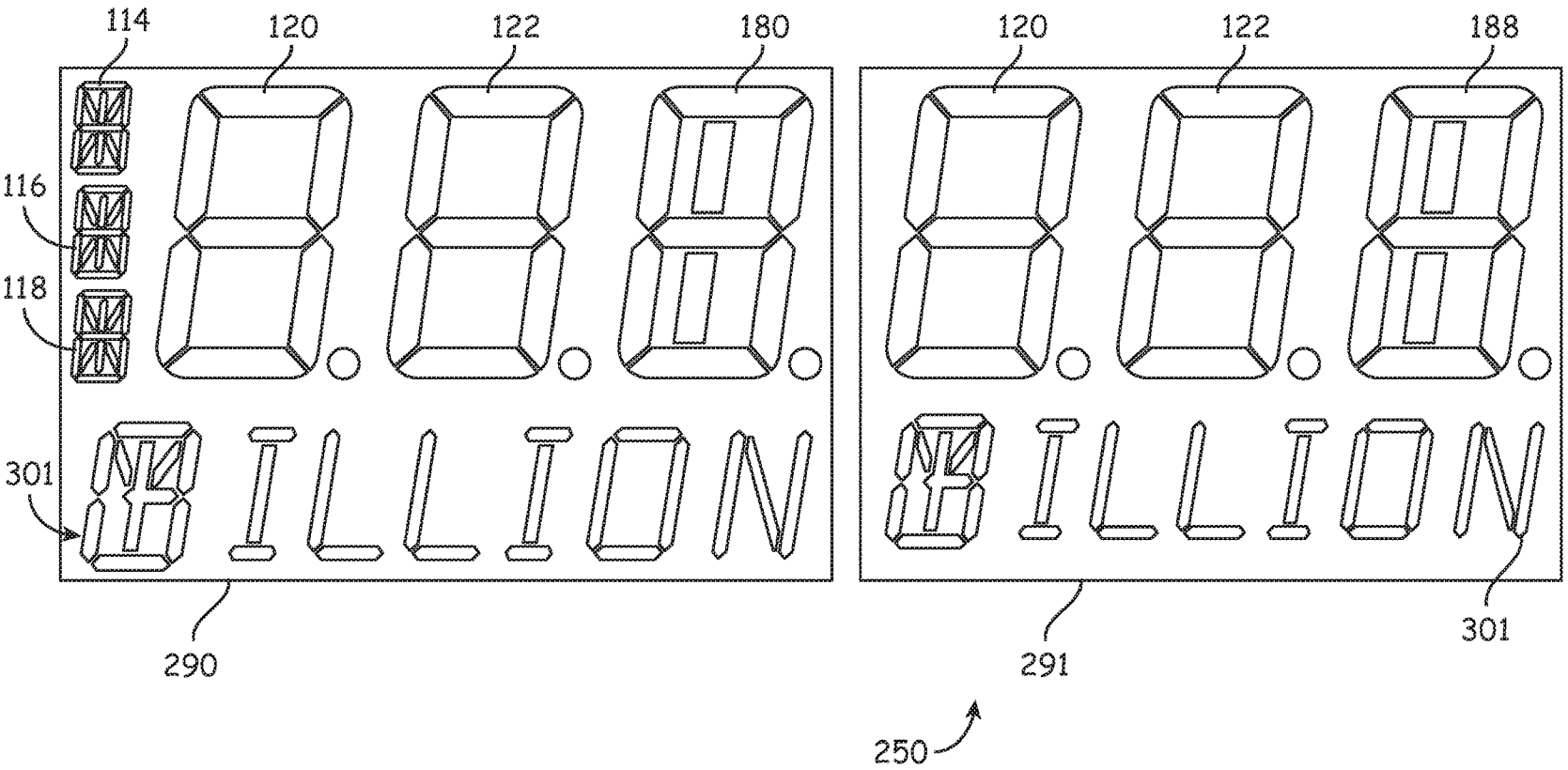
FIG. 12 is a front view of a lottery sign with the graphic overlay removed, where the jackpot information for two lotteries is placed side-by-side.

FIG. 12 is a front view of a lottery sign 250 with the graphic overlay removed, where the jackpot information for two lotteries is placed side-by-side. The lottery sign 250 has a first display 290 and a second display 291. Display 290 comprises three, vertically stacked, alphanumeric LED modules 114, 116, and 118. In one or more embodiments, LED modules 114, 116, and 118 each have 13 line segments. These three LED modules 114, 116, and 118 may be employed to indicate a day of the week such as the day of the next lottery draw. The modules 114, 116, and 118 may be selectively illuminated to vertically form the visual indicia for "MON," "TUE," "WED," "THU," "FRI," "SAT," or "SUN." First display 290 has three LED modules 120, 122, and 180 positioned next to each other for displaying the jackpot amount as well as the Currency Number Scale LED module 301. Second display 291 also has three LED modules 120, 122, and 180 positioned next to each other for displaying the jackpot amount as well as the Currency Number Scale LED module 301.

Figure 13:
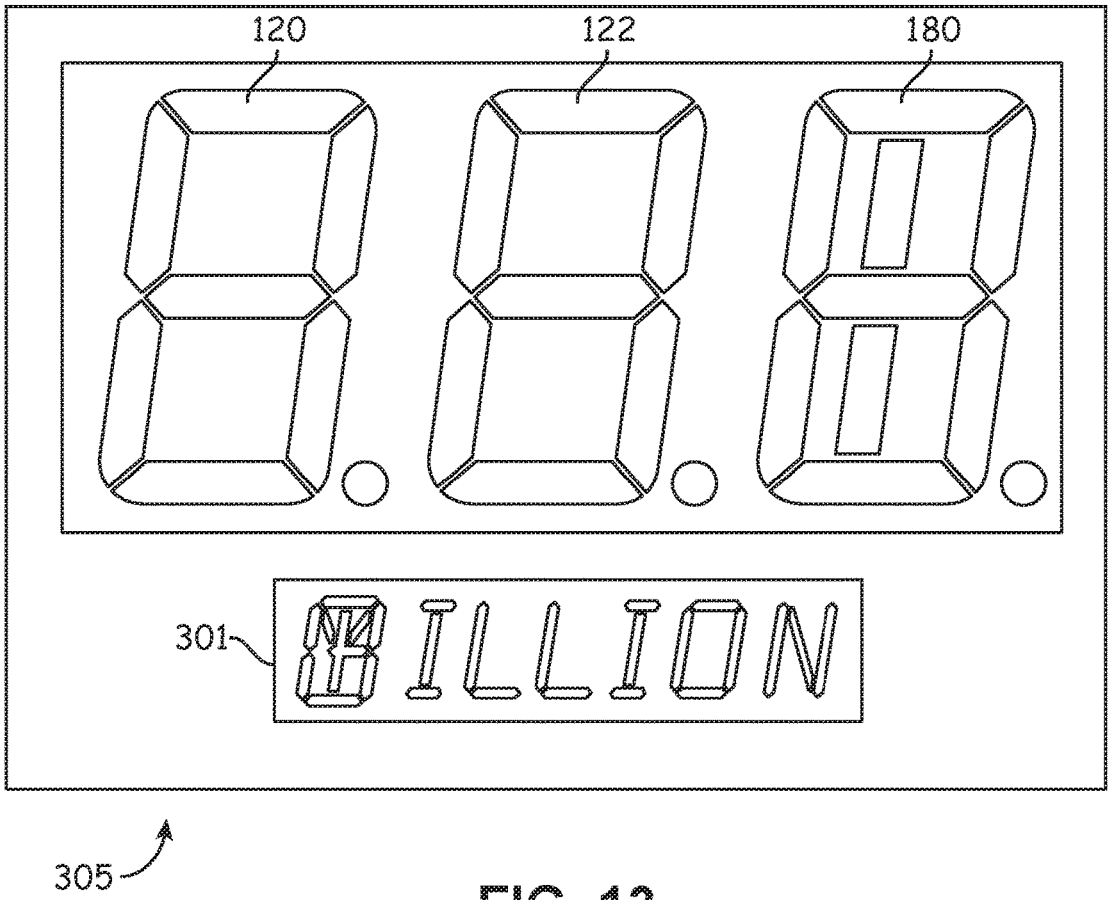
FIG. 13 is a front view of a lottery sign with the graphic overlay removed showing greater detail of the two, seven segmented LED modules, the nine segment LED module, and the currency number scale in one or more embodiments.

FIG. 13 is a front view of a lottery sign 305 with the graphic overlay removed showing greater detail of the two, seven segmented LED modules 120 and 122, the nine segment LED module 180, and the Currency Number Scale LED module 301 in one or more embodiments.

Figure 14:
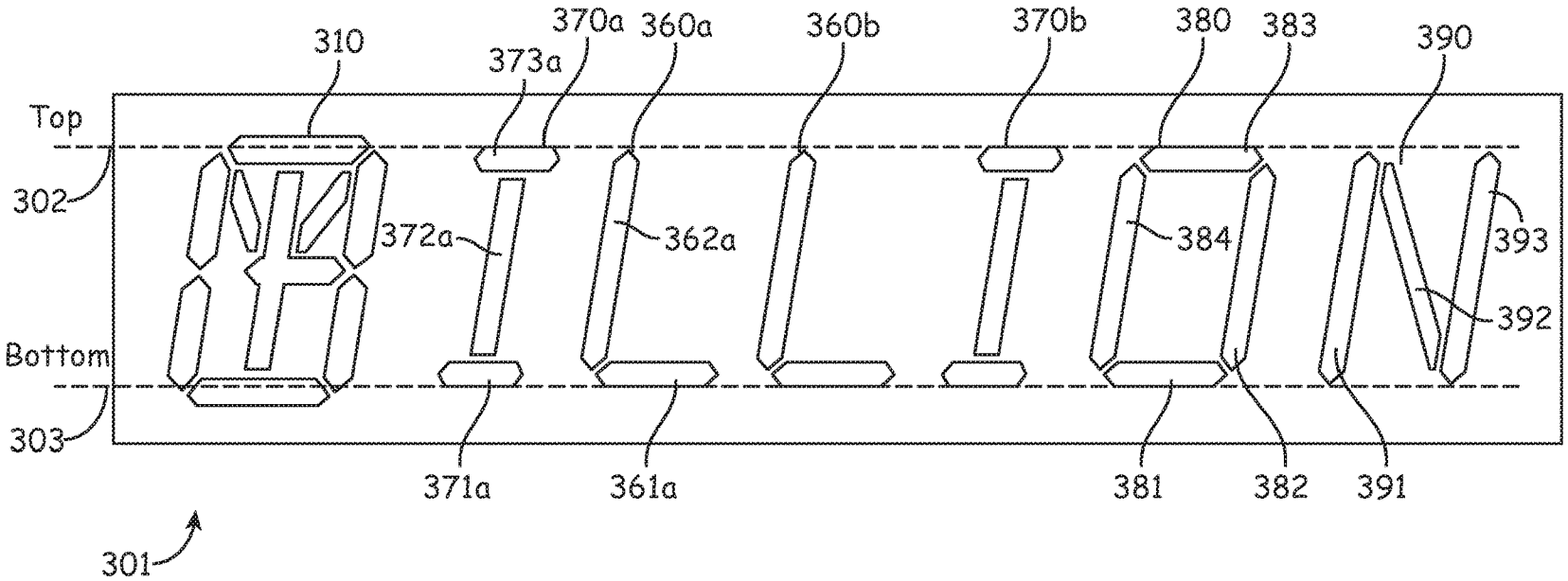
FIG. 14 is a front view of the currency number scale LED array comprising custom, segmented displays which may display either "MILLION" or "BILLION."

FIG. 14 is a front view of the Currency Number Scale LED module 301 having tailored, segmented displays which may display either "MILLION" or "BILLION." Currency Number Scale LED module 301 comprises a M/B LED display 310 (i.e., an LED module mounted in the housing for representing an uppercase letter "M" or an uppercase letter "B") and a series of LED elements configured to provide visual indicia of "ILLION" placed immediately to the right of the M/B LED display 310. The M/B LED display 310 provides visual indicia of the words "MILLION" or "BILLION."

An upper case "I" display is formed twice (370*a* and 370*b*) with both having a top and bottom horizontal elongated LED segment (371*a* and 373*a*) separated by a centered vertical elongated LED segment 372*a* positioned to form visual indicia of an uppercase letter "I."

An upper case "L" display is formed twice (360*a* and 360*b*) with both having a left vertical elongated LED segment 362*a* and a bottom horizontal elongated LED segment 361*a* positioned to form a visual indicia of an uppercase letter "L."

An upper case "O" display 380 and has a left vertical elongated LED segment 384 and right vertical elongated LED segment 382, as well as a top horizontal elongated LED segment 383 and a bottom horizontal LED segment 381 positioned to form a visual indicia of an uppercase letter "O."

An upper case "N" display 390 and has a left vertical elongated LED segment 391 and right vertical elongated LED segment 393, as well as a diagonal elongated LED segment 392 positioned to form a visual indicia of an uppercase letter "N."

Figure 15:
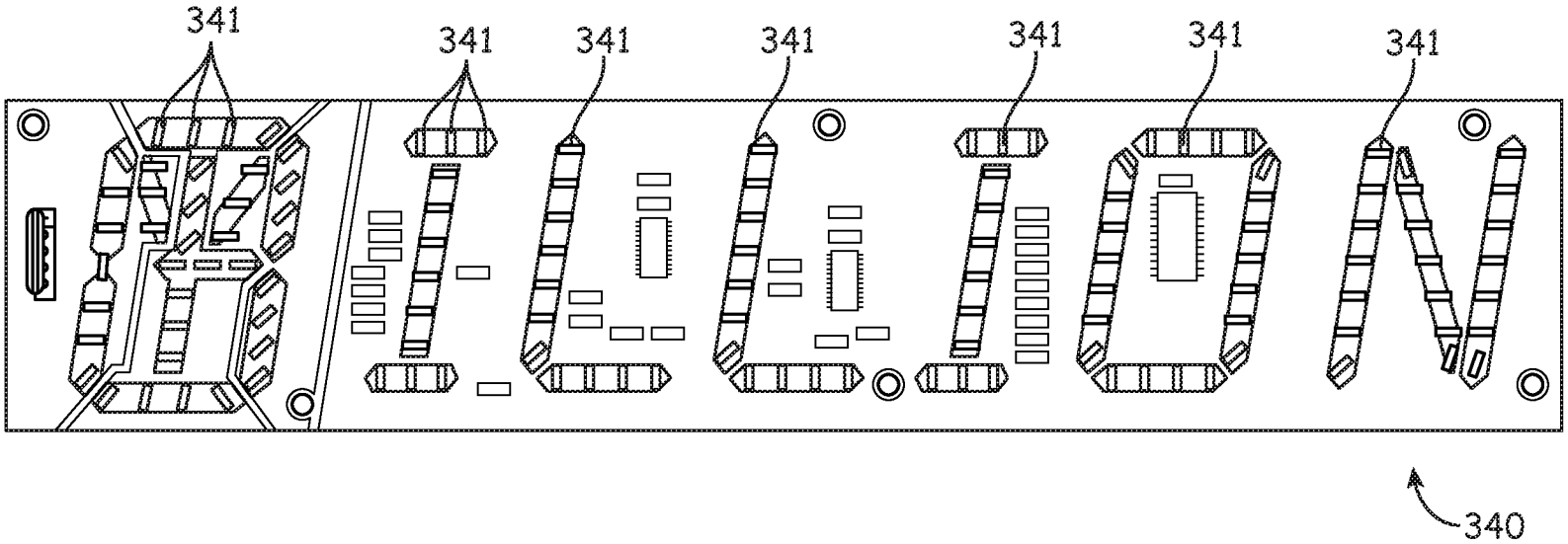
FIG. 15 is a front view of an exemplary printed circuit board having discrete LEDs positioned to form either "MILLION" or "BILLION."

FIG. 15 is a front view of an exemplary printed circuit board 340 having discrete LEDs 341 positioned to form indicia of either "MILLION" or "BILLION" for the Currency Number Scale LED module 301. The printed circuit board 340 has multiple discrete LEDs 341 positioned to form the M/B LED display as well as the series of LED elements configured to provide visual indicia of "ILLION" placed immediately to the right of the M/B LED display.

Figure 16:
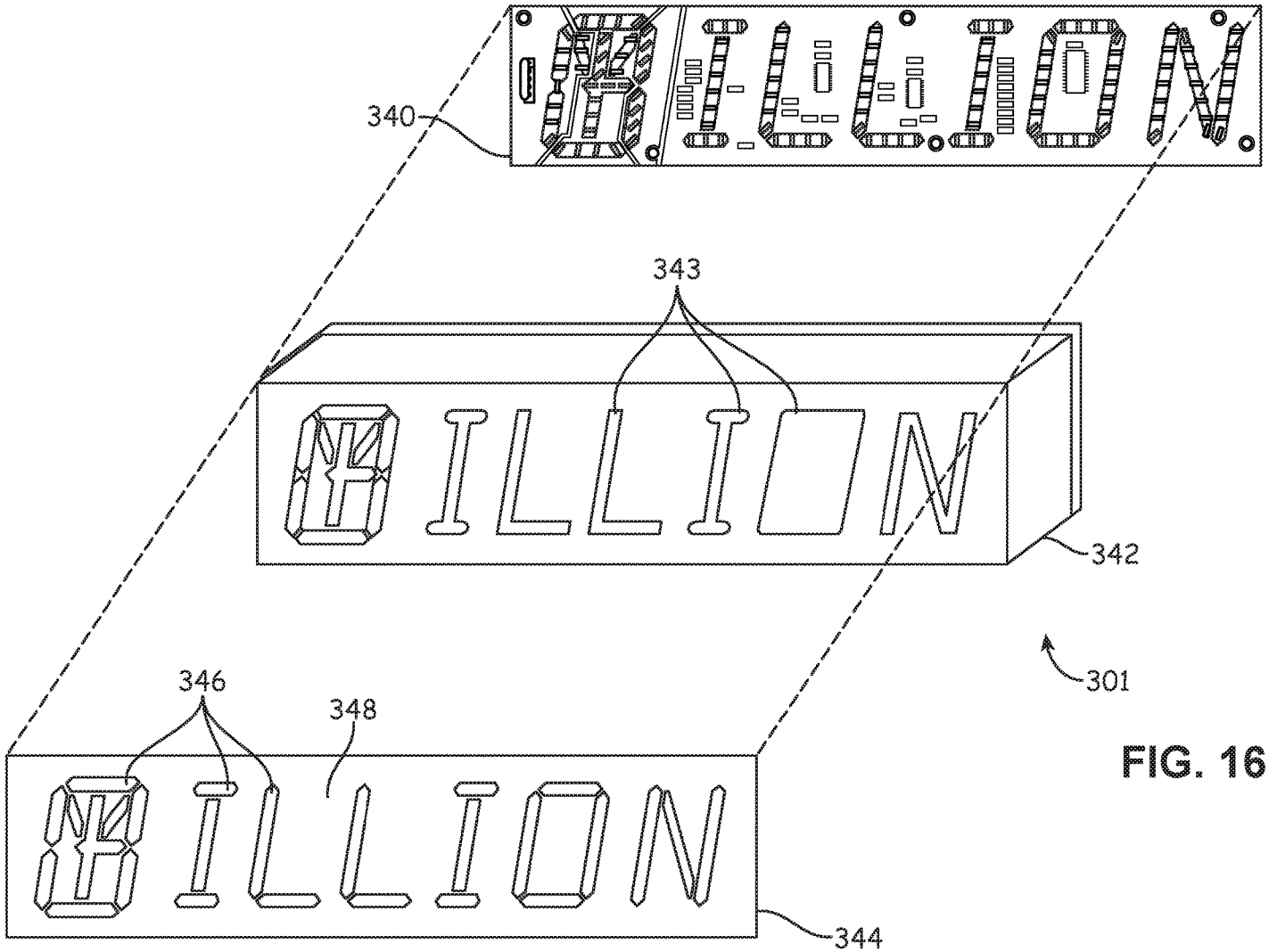
FIG. 16 is an exploded view of an LED currency number scale having a printed circuit board, a plastic housing, and a graphic overlay in one or more embodiments.

FIG. 16 is an exploded view of an LED currency number scale 301 having a printed circuit board 340, a plastic housing 342, and a graphic overlay 344 in one or more embodiments. The plastic housing 342 is milled to form multiple openings 343 shaped to form the MILLION or BILLION. The graphic overlay 344 has a generally opaque background 348 as well as multiple dispersion windows 346 shaped to form the display for "MILLION" or "BILLION." The density of the LEDs 341 on the printed circuit board 340 and the dispersion windows 341 serve to provide segments with uniform illumination intensity.

Figure 17:
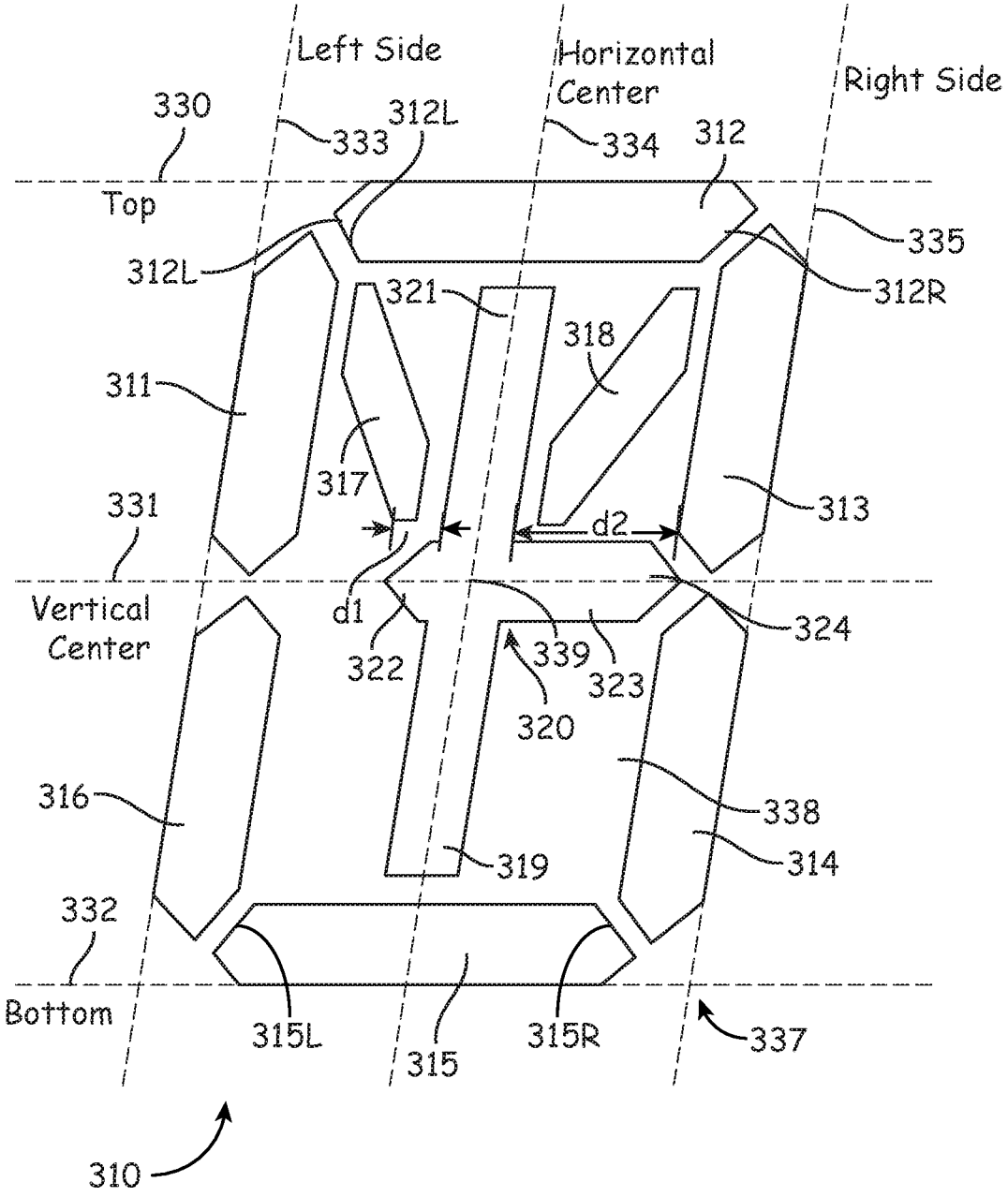
FIG. 17 is a front view of an LED module configured to display either an uppercase "M" or an uppercase "B."

FIG. 17 is a front view of M/B LED Display 310 (i.e., an LED module configured to display either an uppercase "M" or an uppercase "B.") The M/B LED Display 310 comprises a plurality of LED elements disposed to form a generally parallelogram perimeter 337 with perimeter having a top side marked by line 330, a bottom side marked by line 332, a left side marked by line 333, and a right side as marked by line 335. The plurality of LED elements has at least one top side LED element 312, at least one bottom side LED element 315, at least one right side LED element (collectively LED elements 313 and 314), and at least one left side LED element (collectively LED elements 311 and 316).

The at least one left side LED element (collectively LED elements 311 and 316) extends from the left side 315L of the bottom side LED element 315 to the left side 312L of the top side LED element 312.

The at least one left side LED element (collectively 311 and 316) comprises a top left side LED element 311 and a bottom left side LED element 316. The top left side LED element 311 is collinear with the bottom left side element 316. The top left side LED element 311 is positioned above the bottom left side LED element 316.

The right side LED element (collectively LED elements 313 and 314) extends from the right side 315R of the bottom side LED element 315 to the right side 312R of the top side LED element 312.

The at least one right side LED element (collectively 313 and 314) comprises a top right side LED element 313 and a bottom right side LED element 314. The top right side LED element 313 collinear with the bottom right side element 314. The top right side LED element 313 is positioned above the bottom right side LED element 314.

The M/B LED Display 310 further comprises at least one left diagonal LED element 317 and at least one right diagonal LED element 318 positioned within the interior 338 of the plurality of LED elements disposed to form the generally parallelogram perimeter 337. The left diagonal LED element 317 extends from the left side 312L of the top side LED element 312 toward the center 339 of the plurality of LED element disposed to form the parallelogram perimeter 337. The right diagonal LED element 318 extends from the right side 312R of the top side LED element 312 toward the center 339 of the plurality of LED element disposed to form the parallelogram perimeter 337.

The M/B LED Display 310 further comprises at least one interior LED element 320 positioned near the center 339 of the parallelogram perimeter 337 extending toward the right side LED (collectively 313 and 314). The one interior LED element 320 has a generally vertical arm 319 extending from near the at least one bottom LED element 315 to near the at least one top LED element 312. The interior LED element 320 has a right horizontal arm 323 extending from the center 339 of the parallelogram perimeter to near the top and bottom right LED elements 313 and 314.

In a preferred embodiment, the interior LED element 320 further comprises a protrusion 322 extending from the center 339 of the parallelogram perimeter 337 to the right, wherein the protrusion 322 does not extend to the top and bottom left LED element.

In other words, the M/B LED Display 310 (i.e., an LED module mounted in the housing for representing an uppercase letter "M" or an uppercase letter "B") comprises two substantially horizontal and elongated LED line segments 312 and 315 including a top 312 and bottom horizontal line segment 315, two aligned, substantially vertical, collinear and elongated LED line segments 311 and 316 positioned immediately to the left of the top and bottom horizontal line segments comprising a top left vertical line segment 311 and a bottom left vertical line segment 315.

The M/B LED Display 310 further comprises two aligned, substantially vertical, collinear and elongated LED line segments 313 and 314 positioned on the right of the top and bottom horizontal line segments comprising a top right vertical line segment 313 and a bottom right vertical line segment 314.

The M/B LED Display 310 further comprises an interior LED element 320 positioned between the top and bottom horizontal line segments 312 and 315. The interior LED element 320 is shaped as an asymmetrical cross having a generally vertical arm 319 centered and parallel with the top right vertical line segment 313 and a bottom right vertical line segment 314. The generally vertical arm 320 extends from near the bottom horizontal line segment 315 to near the top horizontal line segment 312. The interior LED element has a right horizontal arm 323 extending from the horizontal center of the vertical arm 319 toward the right with a distal end adjacent to the top right vertical line segment 313 and the bottom right vertical line segment 314.

In a preferred embodiment, the interior LED element 320 further comprises a left horizontal protrusion 322 extending from the horizontal center of the vertical arm 321 toward the left, where the horizontal length of the right horizontal arm ($d_2$) is larger than the horizontal length of the left horizontal protrusion ($d_1$). In a preferred embodiment, the left protrusion is formed with two bevels to form a triangular shape, and is substantially shorter than the horizontal length of the right horizontal arm $d_2$.

The M/B LED Display 310 further comprises a left diagonal elongated LED line segment 317 extending from the interior LED element 320 to the left side 312L of the top horizontal line segment 312, and a right diagonal elongated LED line segment 318 extending from the interior LED element 320 to the right side 312R of the top horizontal line segment 312.

Figure 18:
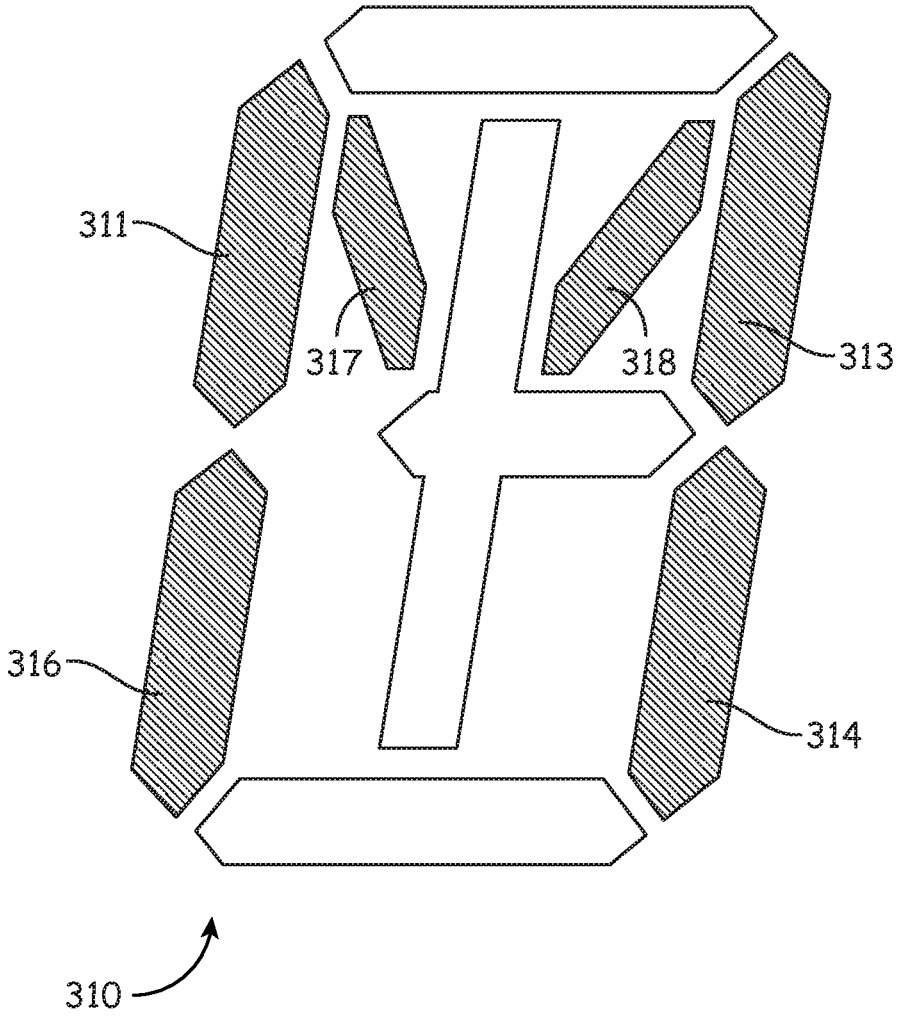
FIG. 18 is a front view of the LED module, where the hashed LED segments form an uppercase "M."

FIG. 18 is a front view of the M/B LED Display 310, where the hashed LED segments form an uppercase "M." As shown, the segments having hash marking are illuminated.

Bottom left vertical line segment 316, top left vertical line segment 311, left diagonal elongated LED line segment 317, right diagonal elongated LED line segment 318, top right vertical line segment 313, and bottom right vertical line segment 314 are illuminated to form an uppercase letter "M."

Figure 19:
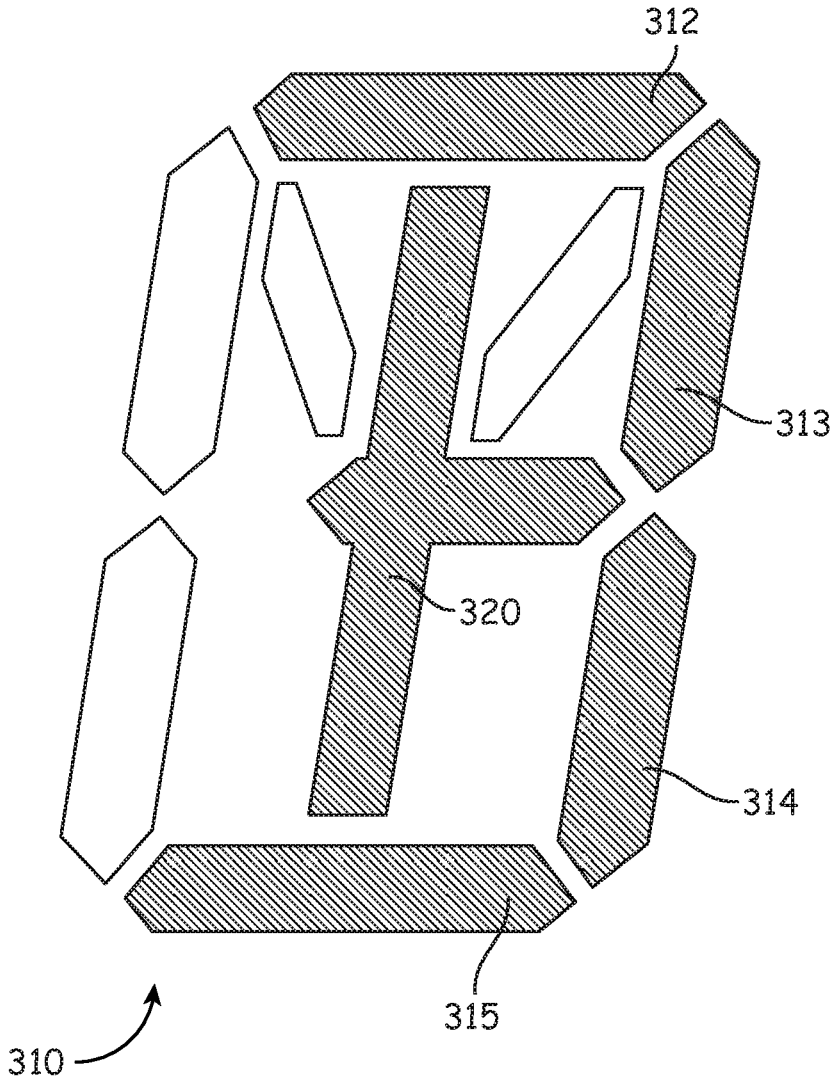
FIG. 19 is a front view of the LED module, where the hashed LED segments form an uppercase "B."

FIG. 19 is a front view of the LED module, where the hashed LED segments form an uppercase "B." Top horizontal line segment 312 top right vertical line segment 313, bottom right vertical line segment 314, bottom left vertical line segment 315, and interior LED element 320 are illuminated to form an uppercase letter "B."

Figure 20:
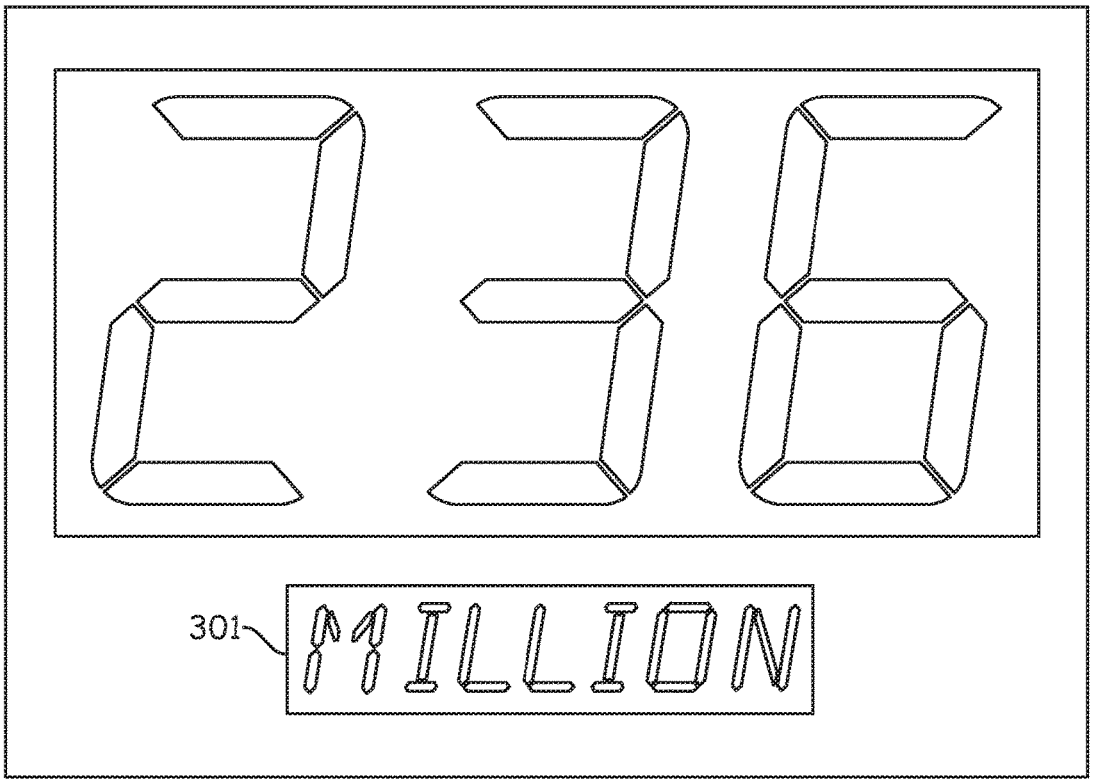
FIG. 20 is a front view of a lottery sign depicted in FIG. 13 where the sign indicates a jackpot of 236 MILLION Dollars.
Figure 21:
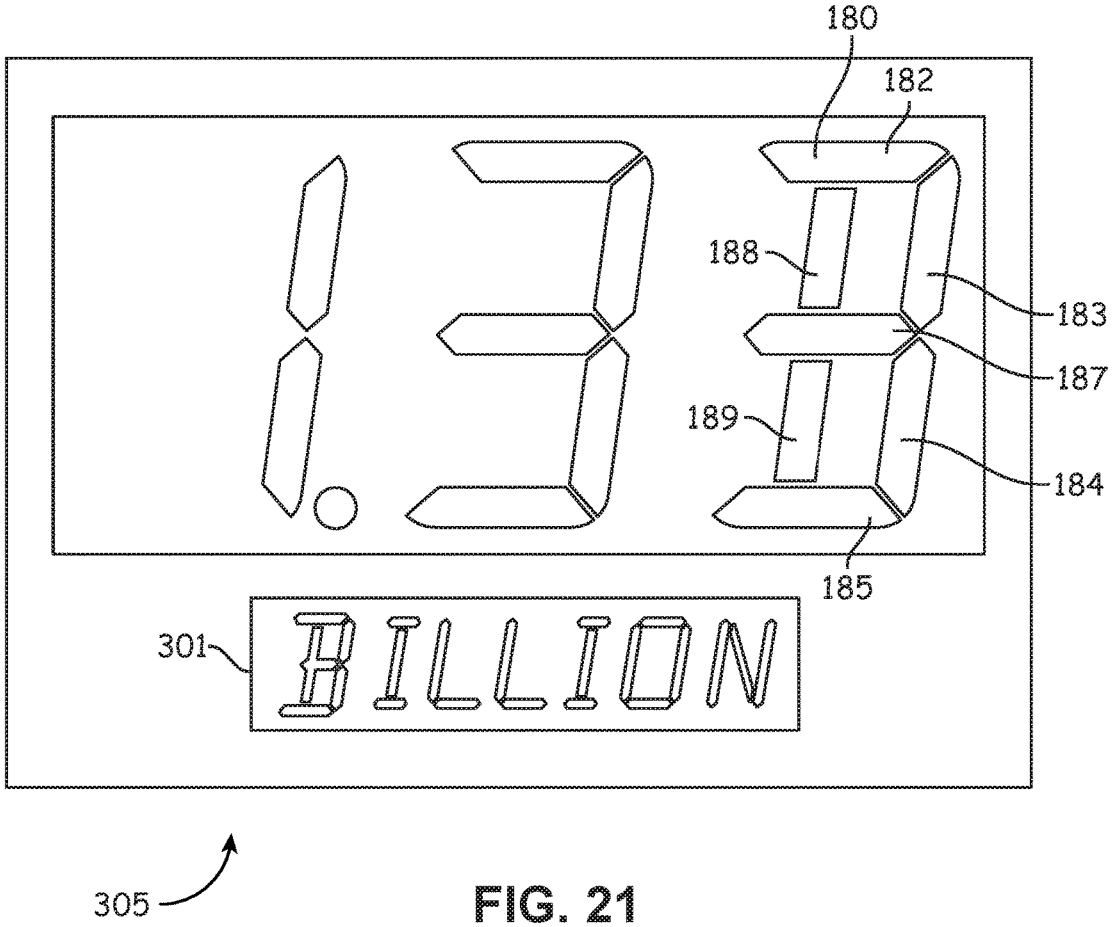
FIG. 21 is a front view of a lottery sign depicted in FIG. 13 where the sign indicates a jackpot of 1.3 BILLION Dollars.

FIG. 20 is a front view of a lottery sign depicted in FIG. 13 where the sign indicates a jackpot of 236 MILLION. FIG. 21 is a front view of a lottery sign depicted in FIG. 13 where the sign indicates a jackpot of 1.3 BILLION. Hence, the value of the jackpot is unambiguously displayed with clear indicia of "MILLION" or "BILLION."

Figure 22:
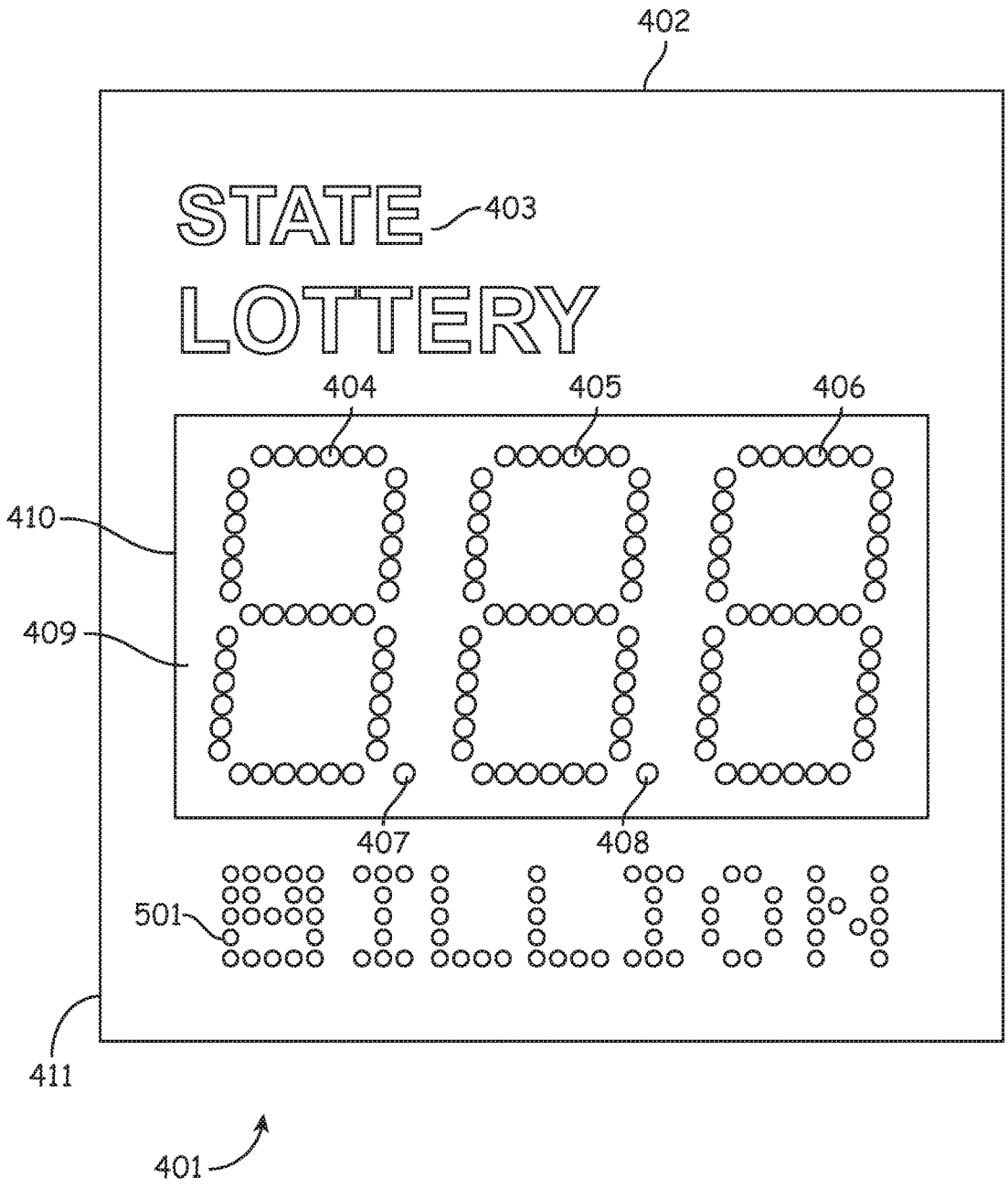
FIG. 22 is a front view of a lottery sign with the graphic overlay is removed illustrating embodiments employing discrete LEDs.

FIG. 22 is a front view of a lottery sign 401 with a graphic overlay 440 illustrating embodiments employing discrete LEDs. The illuminated lottery sign 401 has a graphic overlay 402 placed over an illuminated panel 411 holding the components. Visual indicia of a lottery 403 is formed in the graphic overlay 402. When the panel 411 is illuminated, visual indicia of "STATE LOTTERY" is displayed. The lottery sign 401 has a window 410 over a light emitting array 409.

Figure 23:
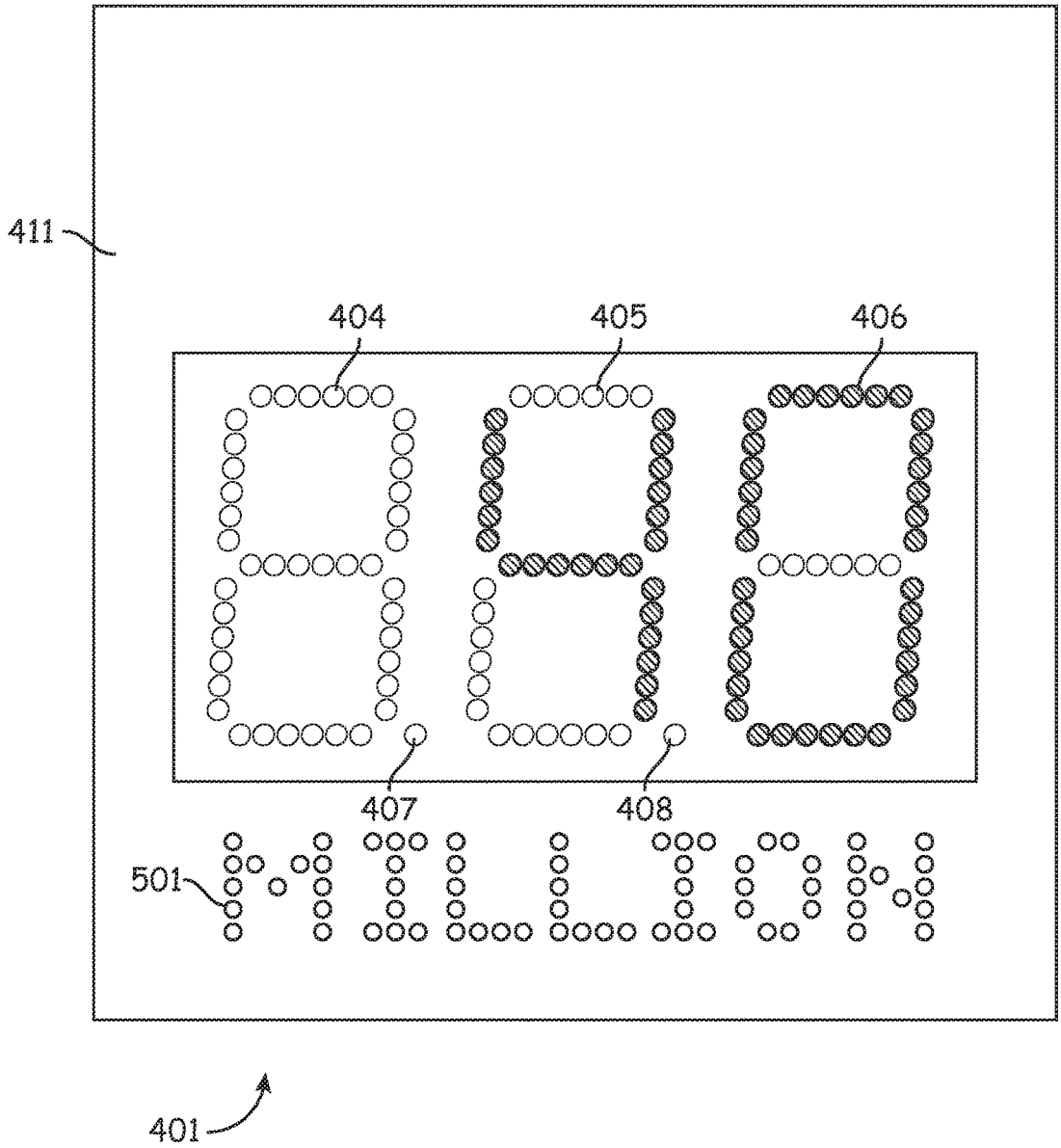
FIG. 23 is a front view of a lottery sign depicted in FIG. 22, where the sign indicates a jackpot of 40 MILLION Dollars.

Light emitting array 408 also has three LED modules 404, 405, and 406 positioned next to each other. The leftmost LED module 404 nominally provides indicia of the hundreds place for the jackpot value, the center LED module 405 nominally provides indicia of the tens place, and the rightmost LED module 406 nominally provides indicia of the units value of the jackpot. The light emitting array 409 also has first and second decimal points 407 and 408. The lottery sign 401 also has a Currency Number Scale LED module 501 which can display either "MILLION" or "BILLION." FIG. 23 is a front view of a lottery sign depicted in FIG. 22, where the sign indicates a jackpot of 40 MILLION Dollars.

Figure 24:
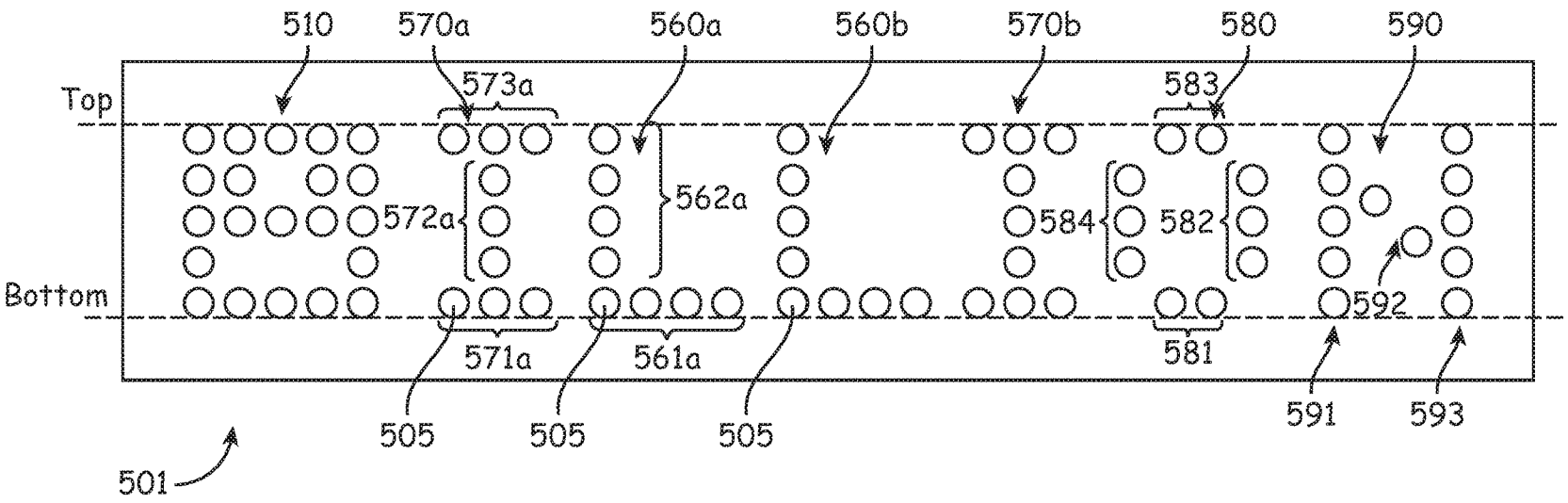
FIG. 24 is a front view of a currency number scale LED array employing discrete LEDs which may display either "MILLION" or "BILLION."

FIG. 24 is a front view of a currency number scale LED array 501 employing discrete LEDs 505 which may display either "MILLION" or "BILLION." Currency Number Scale LED module 301 comprises a M/B LED display 310 (i.e., an LED module mounted in the housing for representing an uppercase letter "M" or an uppercase letter "B") and a series of LED elements configured to provide visual indicia of "ILLION" placed immediately to the right of the M/B LED display. The M/B LED display 510 and the series of LED elements configured to provide visual indicia of "ILLION" provide visual indicia of the words "MILLION" or "BILLION."

An upper case "I" display is formed twice (570*a* and 570*b*) with both having a top and bottom horizontal row of LED elements (573*a* and 571*a*) separated by a centered vertical column of LED elements 572*a* positioned to form visual indicia of an uppercase letter "I."

An upper case "L" display is formed twice (560*a* and 560*b*) with both having a left vertical column of LED elements 562*a* and a bottom horizontal row of LED elements 561*a* positioned to form a visual indicia of an uppercase letter "L."

An upper case "O" display 580 and has a left vertical column of LED elements 584 and right vertical column of LED elements 582, as well as a top horizontal row of LED elements 383 and a bottom horizontal row of LED elements 581 positioned to form a visual indicia of an uppercase letter "O."

An upper case "N" display 590 and has a left vertical column of LED elements 591 and right vertical column of LED elements 593, as well as a diagonal set of LED elements 592 positioned to form a visual indicia of an uppercase letter "N."

Figure 25:
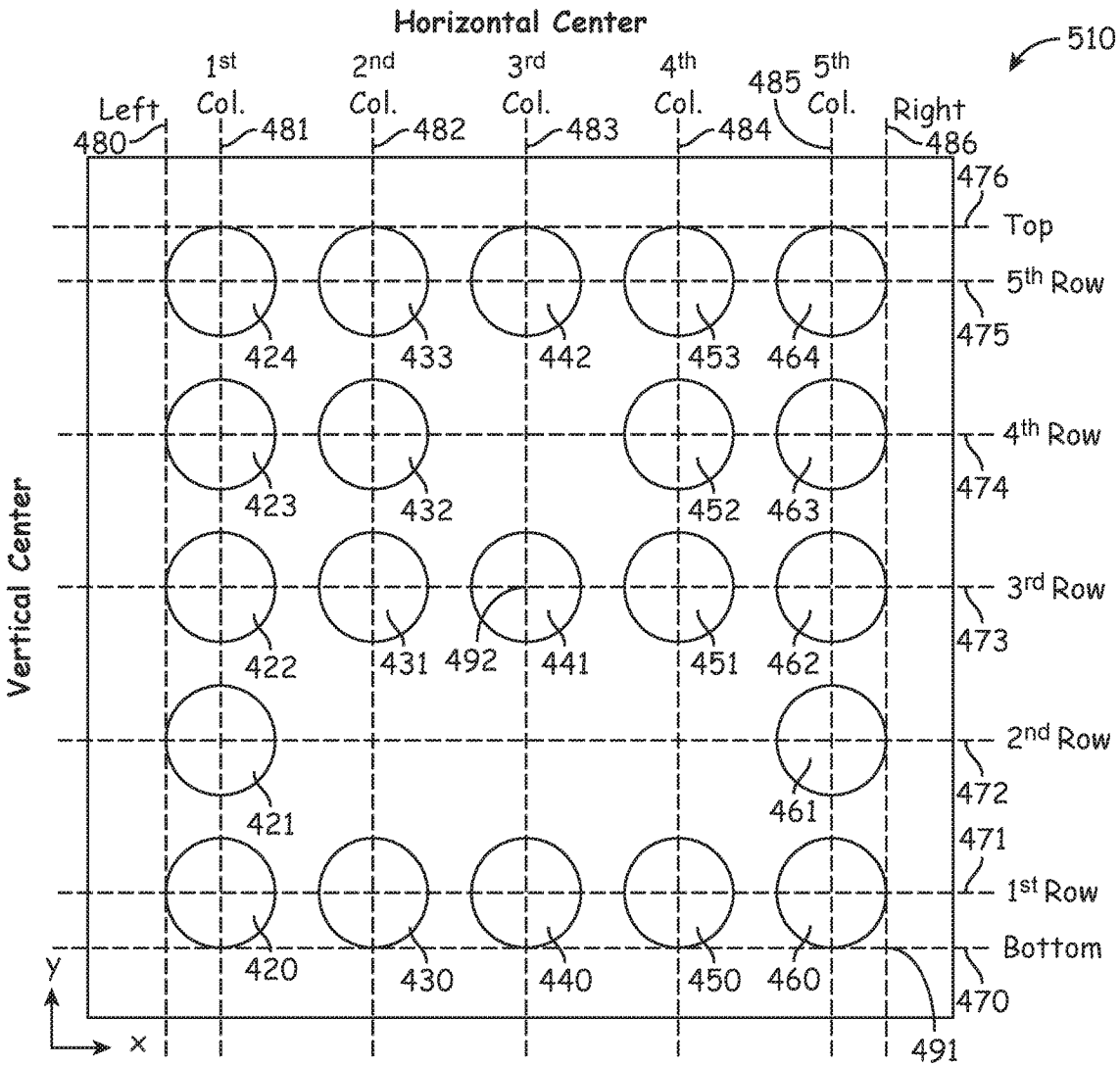
FIG. 25 is a front view of an LED module configured to display either an uppercase "M" or an uppercase "B."

FIG. 25 is a front view of M/B LED Display 510 (i.e., an LED module configured to display either an uppercase "M" or an uppercase "B.") The M/B display 510 may be arranged in a partially populated "m×n" matrix having m rows in a horizontal direction and n columns in a vertical direction, wherein m and n are integers. As shown in FIG. 25, there are five columns including the first column 481, the second column 482, the third column 483, the fourth column 484, and the fifth column 485. There are five rows including the first row 471, the second row 472, the third row 473, the fourth row 474, and the fifth row 475. The center of the matrix is at 491, which is the intersection of the third column and the third row.

The M/B LED Display 510 comprises a plurality of LED elements disposed to form a generally parallelogram perimeter 491 having a top side marked by line 476, a bottom side marked by line 470, a leftmost side marked by line 480, and a rightmost side marked by line 486.

The M/B LED Display 510 has at least one top side LED element (collectively LED elements 424, 433, 442, 453, and 464), at least one bottom side LED element (collectively LED elements 420, 430, 440, 450, and 460).

The M/B LED Display 510 has at least one right side LED element (collectively LED elements 464, 463, 462, 461, and 460 where element 464 is also part of the top side LED element and 460 is also part of the bottom side LED element. The right side LED element extends from the right side of the bottom side LED element (LED element 460) to the right side of the top side LED element (LED element 464).

The M/B LED Display 510 has at least one left side LED element (collectively LED elements 424, 423, 422, 421, and 420, where LED element 424 is also part of the top side LED element and LED element 420 is also part of the bottom side LED element). The left side LED element extends from the left side of the bottom side LED element (LED element 420) to the left side of the top side LED element (LED element 424).

The M/B LED Display 510 has at least one left diagonal LED element (collectively LED elements 424, 432, and 441, where 424 is also part of the top side and right side LED elements). The M/B LED Display 510 has and at least one right diagonal LED element (collectively LED elements 464, 452, and 441, where LED element 464 is also part of the top side and right side LED element, and LED element 441 is also part of the left diagonal element).

The left and right diagonal LED elements are positioned within the interior of the plurality of LED elements disposed to form the generally parallelogram perimeter, the left diagonal LED element extending from the left side of the top side LED element toward the center of the plurality of LED element disposed to form the parallelogram perimeter, the right diagonal LED element extending from the right side of the top side LED element toward the center of the plurality of LED element disposed to form the parallelogram perimeter.

The M/B LED Display 510 has at least one interior LED element (collectively LED elements 441, 451, and 463) positioned near the center of the parallelogram perimeter extending toward the right side LED.

In other words, the M/B LED Display 510 at least one left side LED element comprises a left, collinear vertical stack of "m" discrete LEDs, where "m" is an integer (as shown m=5, the left, collinear vertical stack including LED elements 424, 423, 422, 421, and 420).

The at least one right side LED element comprises a right, collinear vertical stack of "m" discrete LEDs (as shown in FIG. 25, the right, collinear vertical stack includes LED elements 464, 463, 462, 461, and 460). The at least one top side LED element comprises a top horizontal row of "n" discrete LEDs, where "n" is an integer (as shown, n=5, the top horizontal row includes 424, 433, 442, 453, and 464).

The at least one bottom side LED element comprises a bottom horizontal row of "n" discrete LEDs (as shown, the bottom horizontal row includes 420, 430, 440, 450, and 460). The at least one interior LED element comprise a middle horizontal row of "n" discrete LEDs (as shown, the middle horizontal row includes LED elements 422, 431, 441, 451, and 462).

The at least one left diagonal LED element comprises one or more left diagonal discrete LEDs (as shown, the left diagonal includes LED elements 424, 432, and 441). The at least one right diagonal LED element comprises one or more right diagonal discrete LEDs (as shown, the right diagonal includes LED elements 464, 452, and 441).

In other words, the M/B LED Display 510 (i.e., an LED module configured to display either an uppercase "M" or an uppercase "B.") has a plurality of LEDs arranged generally in a partially populated m×n matrix form having m rows in a horizontal direction and n columns in a vertical direction, wherein m and n are integers, the plurality of LEDs having a top horizontal row of LEDs placed at the $m^{th}$ row of the matrix, the top horizontal row fully populated with LEDs from the first column to the $n^{th}$ column (as shown, m=5 and n=5, the top horizontal row includes LED elements 424, 433, 442, 453, and 464). As used herein, the term populated refers to a matrix or grid location located at a particular row and column having an LED. Unpopulated refers to a matrix or grid location located at a particular row and column that does not have an LED.

The M/B LED Display 510 has a middle horizontal row of LEDs placed at the middle row of the matrix, the middle horizontal row fully populated with LEDs from the first column to the $n^{th}$ column (as shown, the middle horizontal row includes LED elements 422, 431, 441, 451, and 462).

The M/B LED Display 510 has a bottom horizontal row of LEDs placed at the first row of the matrix, the bottom horizontal row fully populated with LEDs from the first column to the $n^{th}$ column (as shown, the bottom horizontal row includes 420, 430, 440, 450, and 460).

The M/B LED Display 510 has a left vertical column of LEDs placed at the first column of the matrix, the left vertical column fully populated with LEDs from the first row to the $m^{th}$ row (as shown m=5, the left, collinear vertical stack including LED elements 424, 423, 422, 421, and 420).

The M/B LED Display 510 has right vertical column of LEDs placed at the $n^{th}$ column of the matrix, the right vertical column fully populated with LEDs from the first row to the $m^{th}$ row (as shown in FIG. 25, the right, collinear vertical stack includes LED elements 464, 463, 462, 461, and 460).

The M/B LED Display 510 has a left diagonal series of LEDs emerging diagonally from the $m^{th}$ row, first column to the center of the matrix, the left diagonal series of LEDs fully populated (as shown, the left diagonal includes LED elements 424, 432, and 441).

The M/B LED Display 510 has a right diagonal series of LEDs emerging diagonally from the $m^{th}$ row, $n^{th}$ column to the center of the matrix, the right diagonal series of LEDs fully populated (as shown, the right diagonal includes LED elements 464, 452, and 441).

Matrix positions not listed in the plurality of LEDs are unpopulated having no LED elements which includes, as shown in FIG. 25 for m=5 and n=5, positions (second column, second row), (third column, second row), (fourth column, second row, and (third column, fourth row) are not populated with an LED elements.

As shown if the integers "m" and "n" are odd numbered integers, the middle horizontal row is placed the row given by the equation $\{[(m-1)/2]+1\}$, and the center of the matrix is positioned on the $\{[(m-1)/2]+1\}$ row and the $\{[(n-1)/2]+1\}$ column. For m=5, the middle row is the $3^{rd}$ row and for n=5, the center is positioned at the $3^{rd}$ column, third row.

Figure 26:
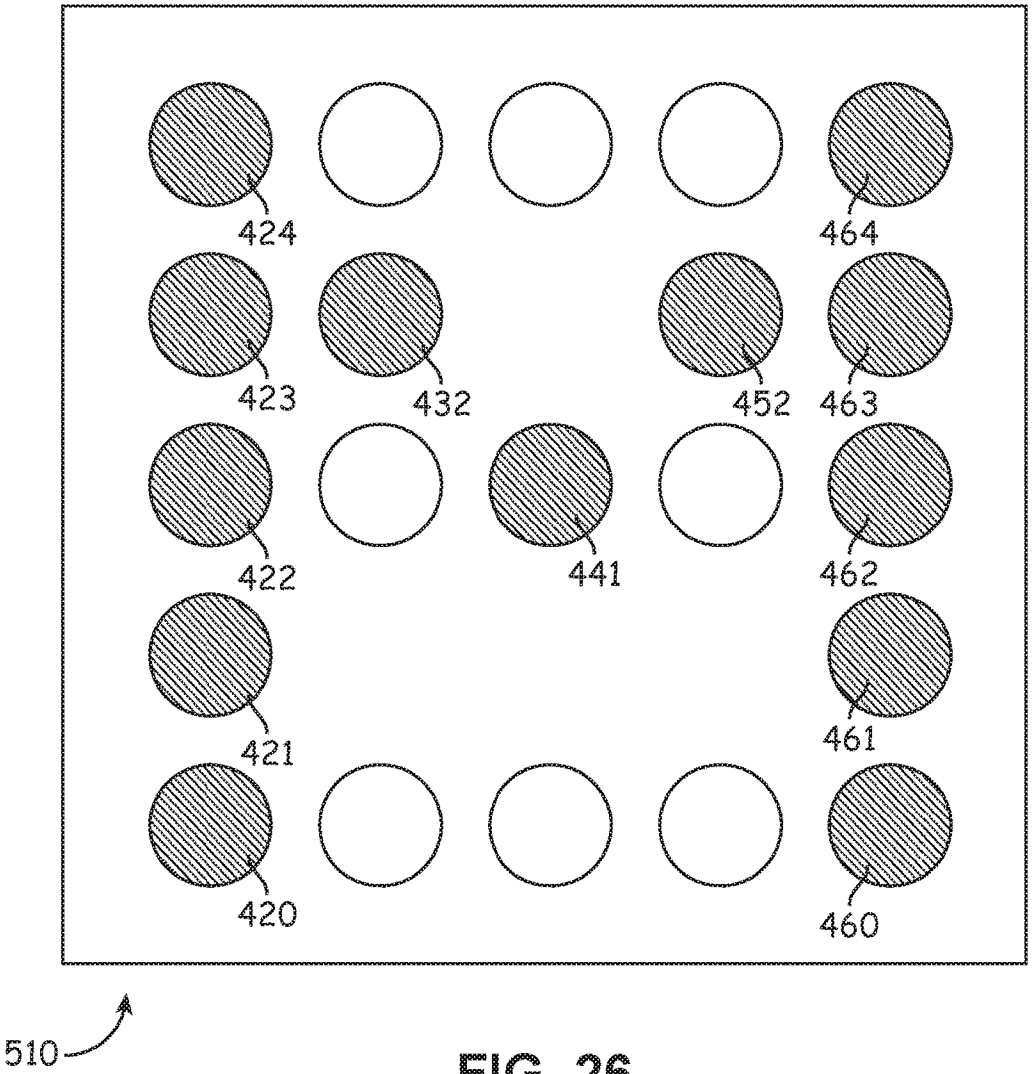
FIG. 26 is a front view of the LED module, where the hashed LED segments form an uppercase "M."

FIG. 26 is a front view of the LED module 510, where the hashed LED segments form an uppercase "M." As shown, LED elements 420, 421, 422, 423, 424, 432, 441, 452, 464, 463, 462, 461 and 460 are illuminated.

Figure 27:
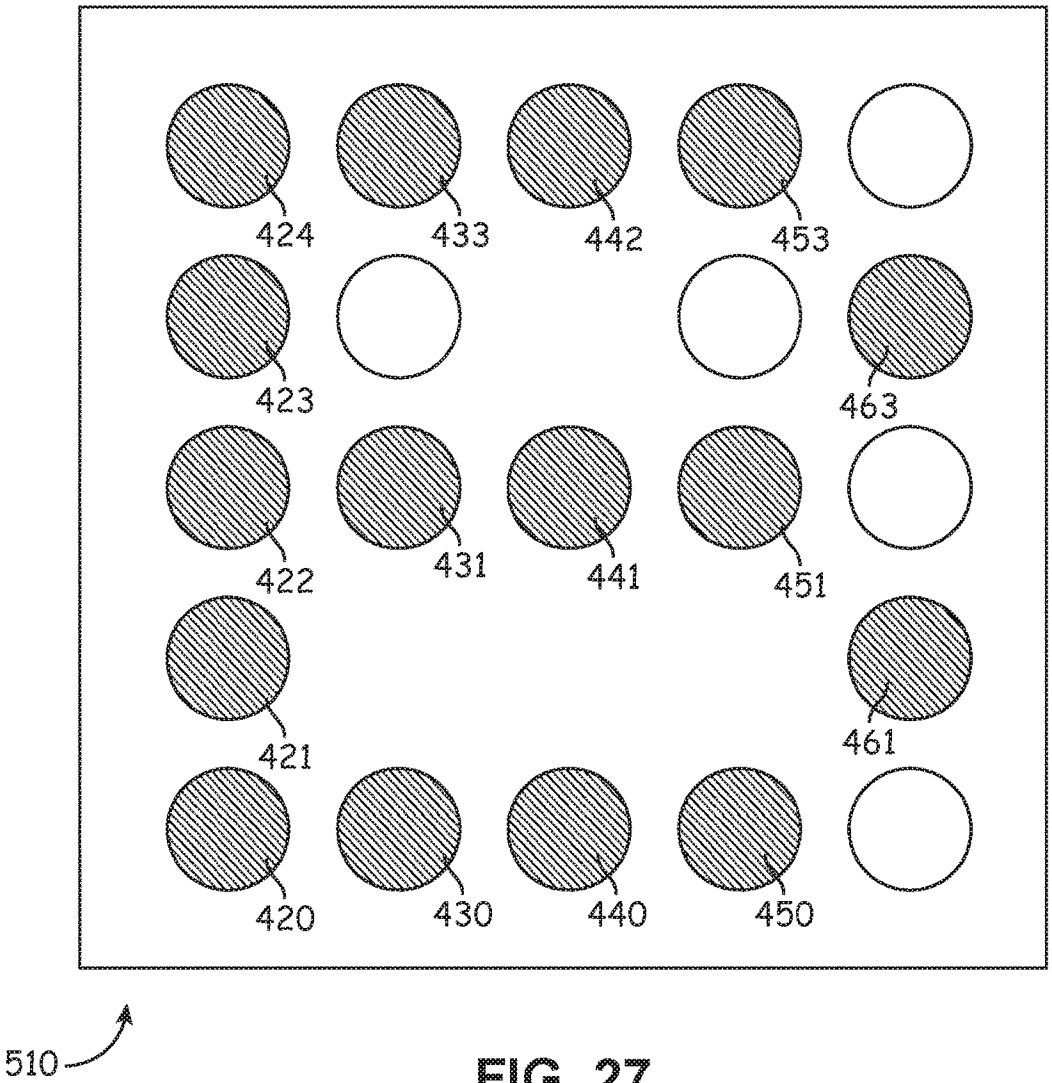
FIG. 27 is a front view of the LED module, where the hashed LED segments form an uppercase "B."

FIG. 27 is a front view of the LED module, where the hashed LED segments form an uppercase "B." As shown, LED elements 420, 421, 422, 423, 424, 433, 442, 453, 463, 451, 441, 431, 461, 450, 440, and 430 are illuminated.

Figure 28:
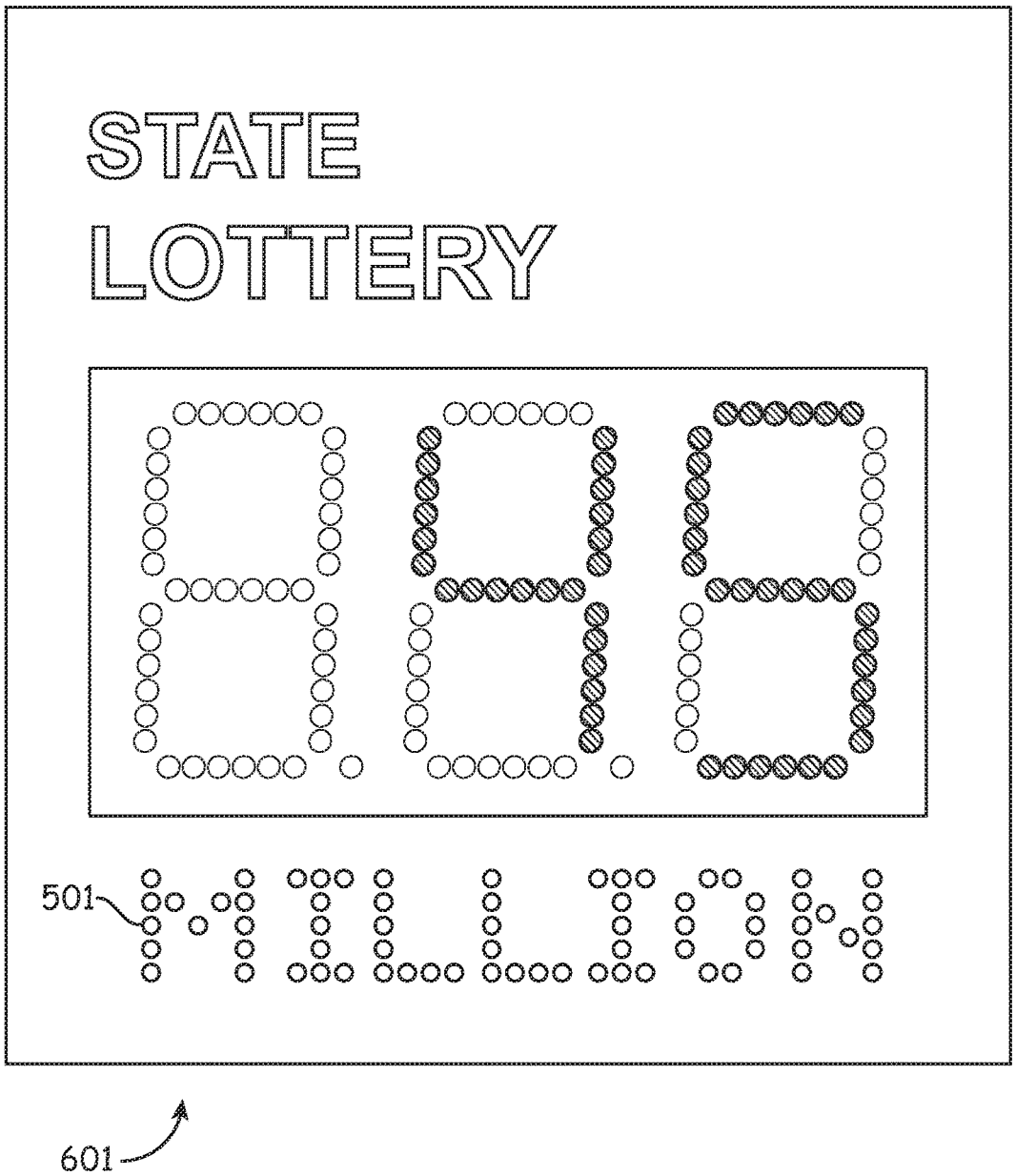
FIG. 28 is a front view of a lottery sign depicted in FIG. 22, where the sign indicates a jackpot of 45 MILLION Dollars.
Figure 29:
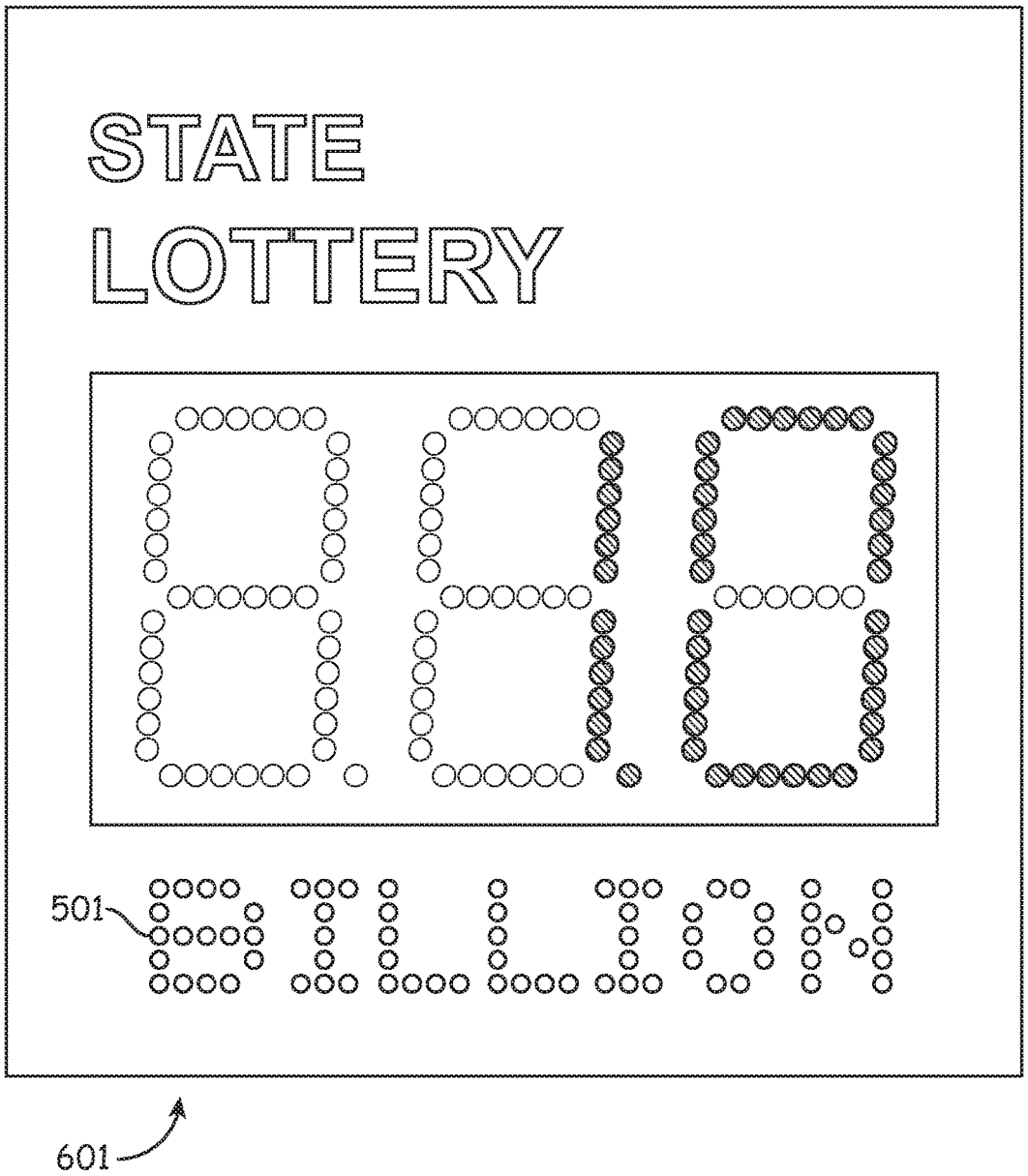
FIG. 29 is a front view of a lottery sign depicted in FIG. 22, where the sign indicates a jackpot of 1.0 BILLION Dollars.

FIG. 28 is a front view of a lottery sign depicted in FIG. 22, where the sign indicates a jackpot of 45 MILLION dollars. FIG. 29 is a front view of a lottery sign depicted in FIG. 22, where the sign indicates a jackpot of 1.0 BILLION dollars. As discussed above, the use of the LED display 510 provides unambiguous identification of the amount of the jackpot.

Although the invention has been discussed with reference to specific embodiments, it is apparent and should be understood that the concept can be otherwise embodied to achieve the advantages discussed. The preferred embodiments above have been described primarily as electronic lottery signs for displaying jackpots in the millions and billions of dollars, where an LED module is configured to display either "MILLION" or "BILLION" having greater visual clarity and reduced components. In this regard, the foregoing description of the lottery signs is presented for purposes of illustration and description. It shall be apparent that various displays would benefit from having a display showing millions or billions of dollars.

Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An illuminated display for displaying a lottery jackpot value in the range of millions and billions of currency, the display comprising:

a flat housing unit having a front surface; and, an LED module mounted in the housing for representing an uppercase letter "M" or an uppercase letter "B" comprising:

a plurality of LED elements disposed to form a generally parallelogram perimeter having at least one top side LED element, at least one bottom side LED element, at least one right side LED element, and at least one left side LED element, the left side LED element extending from the left side of the bottom side LED element to the left side of the top side LED element, the right side LED element extending from the right side of the bottom side LED element to the right side of the top side LED element, at least one left diagonal LED element and at least one right diagonal LED element positioned within the interior of the plurality of LED elements disposed to form the generally parallelogram perimeter, the left diagonal LED element extending from the left side of the top side LED element toward the center of the plurality of LED element disposed to form the parallelogram perimeter, the right diagonal LED element extending from the right side of the top side LED element toward the center of the plurality of LED element disposed to form the parallelogram perimeter, and at least one interior LED element positioned near the center of the parallelogram perimeter extending toward the right side LED; and a series of LED elements configured to provide visual indicia of "ILLION" positioned in the housing and placed immediately to the right of the LED module mounted in the housing for representing an uppercase letter "M" or an uppercase letter "B," wherein the LED module and the series of LED elements provides visual indicia of the words "MILLION" or "BILLION".

2. The illuminated display for displaying a lottery jackpot value in the range of millions and billions of currency of claim 1, wherein:

the at least one left side LED element comprises a top left side LED element and a bottom left side LED element, the top left side LED element collinear with the bottom left side element, the top left side LED element positioned above the bottom left side LED element, the at least one right side LED element comprises a top right side LED element and a bottom right side LED element, the top right side LED element collinear with the bottom right side element, the top right side LED element positioned above the bottom right side LED element, and the at least one interior LED element having a generally vertical arm extending from near the at least one bottom LED element to near the at least one top LED element, the at least one interior LED element having a right horizontal arm extending from the center of the parallelogram perimeter to near the top and bottom right LED elements.

3. The illuminated display for displaying a lottery jackpot value in the range of millions and billions of currency of claim 2, wherein the at least one interior LED element further comprises a protrusion extending from the center of the parallelogram perimeter to the right, wherein the protrusion does not extend to the top and bottom left LED element.

4. The illuminated display for displaying a lottery jackpot value in the range of millions and billions of currency of claim 1, wherein:

the at least one left side LED element comprises a left, collinear vertical stack of "m" discrete LEDs, where "m" is an integer, the at least one right side LED element comprises a right, collinear vertical stack of "m" discrete LEDs, the at least one top side LED element comprises a top horizontal row of "n" discrete LEDs, where "n" is an integer, the at least one bottom side LED element comprises a bottom horizontal row of "n" discrete LEDs, the at least one interior LED element comprise a middle horizontal row of "n" discrete LEDs, the at least one left diagonal LED element comprises one or more left diagonal discrete LEDs, and the at least one right diagonal LED element comprises one or more right diagonal discrete LEDs.

5. The illuminated display for displaying a lottery jackpot value in the range of millions and billions of currency of claim 1, further comprising one or more seven segment light emitting diode ("LED") modules mounted in the housing and configured to provide a visible indicia of numerals.

6. The illuminated display for displaying a lottery jackpot value in the range of millions and billions of currency of claim 4, further comprising a nine segment LED module configured to display indicia of numerals and indicia of an uppercase letter "B".

7. The illuminated display for displaying a lottery jackpot value in the range of millions and billions of currency of claim 5, further comprising:

a transparent backlight panel extending across the front surface of the housing unit; and, a replaceable graphic overlay placed on the front surface of the housing unit, the replaceable graphic overlay configured to be backlit by the backlight panel, the graphic overlay having visible indicia.

8. An illuminated display for displaying a lottery jackpot value in the range of millions and billions of currency, the display comprising:

a flat housing unit having a front surface; and, an LED module mounted in the housing for representing an uppercase letter "M" or an uppercase letter "B" comprising:

two substantially horizontal and elongated LED line segments including a top and bottom horizontal line segments;

two aligned, substantially vertical, collinear and elongated LED line segments positioned immediately to the left of the top and bottom horizontal line segments comprising a top left vertical line segment and a bottom left vertical line segment;

two aligned, substantially vertical, collinear and elongated LED line segments positioned on the right of the top and bottom horizontal line segments comprising a top right vertical line segment and a bottom right vertical line segment;

an interior LED element positioned between the top and bottom horizontal line segments, the interior LED element shaped as an asymmetrical cross having a generally vertical arm centered and parallel with the top right vertical line segment and a bottom right vertical line segment, the generally vertical arm extending from near the bottom horizontal line segment to near the top horizontal line segment, the interior LED having a right horizontal arm extending from the vertical center of the vertical arm toward the right with a distal end adjacent to the top right vertical line segment and the bottom right vertical line segment;

a left diagonal elongated LED line segment extending from the interior LED element to the left side of the top horizontal line segment; and a right diagonal elongated LED line segment extending from the interior LED element to the right side of the top horizontal line segment; and, a series of LED elements configured to provide visual indicia of "ILLION" positioned in the housing and placed immediately to the right of the LED module mounted in the housing for representing an uppercase letter "M" or an uppercase letter "B," wherein the LED module and the series of LED elements provides visual indicia of the words "MILLION" or "BILLION".

9. The illuminated display for displaying the lottery jackpot value in the range of millions and billions of currency of claim 8, wherein the interior LED element further comprising a left horizontal protrusion extending from the vertical center of the vertical arm toward the left, where the horizontal length of the right horizontal arm is larger than the horizontal length of the left horizontal protrusion.

10. The illuminated display for displaying a lottery jackpot value in the range of millions and billions of currency of claim 8, further comprising one or more seven segment light emitting diode ("LED") modules mounted in the housing and configured to provide a visible indicia of numerals.

11. The illuminated display for displaying a lottery jackpot value in the range of millions and billions of currency of claim 8, further comprising a nine segment LED module configured to display indicia of numerals and indicia of an uppercase letter "B".

12. The illuminated display for displaying a lottery jackpot value in the range of millions and billions of currency of claim 8, further comprising:

a transparent backlight panel extending across the front surface of the housing unit; and, a replaceable graphic overlay placed on the front surface of the housing unit, the replaceable graphic overlay configured to be backlit by the backlight panel, the graphic overlay having visible indicia.

13. The illuminated display for displaying the lottery jackpot value in the range of millions and billions of currency of claim 8, further comprising three alphanumeric LED modules configured to display indicia of a day of a week.

* * * * *